US012163667B2

(12) United States Patent
Bruckbauer et al.

(10) Patent No.: US 12,163,667 B2
(45) Date of Patent: Dec. 10, 2024

(54) FUME EXTRACTION DEVICE

(71) Applicant: Wilhelm Bruckbauer, Neubeuern (DE)

(72) Inventors: Wilhelm Bruckbauer, Neubeuern (DE); Walter Koenneker, Rosenheim (DE); Mario Blersch, Brannenburg (DE)

(73) Assignee: WERKHAUS GMBH & CO. KG (DE)

( * ) Notice: Subject to any disclaimer, the term of this patent is extended or adjusted under 35 U.S.C. 154(b) by 993 days.

(21) Appl. No.: 17/261,745

(22) PCT Filed: Jul. 24, 2019

(86) PCT No.: PCT/EP2019/069935
§ 371 (c)(1),
(2) Date: Jan. 20, 2021

(87) PCT Pub. No.: WO2020/020954
PCT Pub. Date: Jan. 30, 2020

(65) Prior Publication Data

US 2021/0341153 A1 Nov. 4, 2021

(30) Foreign Application Priority Data

Jul. 24, 2018 (DE) ..... 102018212330.6
Sep. 11, 2018 (DE) ..... 102018215426.0
Feb. 15, 2019 (DE) ..... 102019202089.5

(51) Int. Cl.
*F24C 15/20* (2006.01)
*F24C 15/10* (2006.01)
*F24C 15/12* (2006.01)

(52) U.S. Cl.
CPC ..... *F24C 15/2042* (2013.01); *F24C 15/10* (2013.01); *F24C 15/12* (2013.01); *F24C 15/2035* (2013.01)

(58) Field of Classification Search
CPC ..... F24C 15/2042
See application file for complete search history.

(56) References Cited

U.S. PATENT DOCUMENTS 4,074,101 A * 2/1978 Kiuchi ..... H02M 5/27 219/601
5,231,972 A * 8/1993 Galassi ..... F24C 15/2042 126/303

(Continued)

FOREIGN PATENT DOCUMENTS

CN 201351954 Y 11/2009
CN 201715603 U 1/2011

(Continued)

OTHER PUBLICATIONS

International Search Report, mailed Jan. 17, 2020, issued in corresponding PCT Application No. PCT/EP2019/069935, filed Jul. 24, 2019.

(Continued)

*Primary Examiner* — Jorge A Pereiro
(74) *Attorney, Agent, or Firm* — POLSINELLI PC

(57) ABSTRACT

A fume extraction device for the downward extraction of cooking fumes comprises at least one inflow opening for the inflow of the cooking fumes, and at least one fan for suctioning the cooking fumes at the at least one inflow opening, such fan having a fan propeller that is mounted so as to be rotatable about a rotation axis, wherein the rotation axis is oriented so as to be inclined in relation to a horizontal plane and to a vertical direction.

11 Claims, 14 Drawing Sheets

(56) References Cited

U.S. PATENT DOCUMENTS

| | | | | |
|---|---|---|---|---|
| 6,512,673 | B1 * | 1/2003 | Wiley | H05K 7/20727 361/689 |
| 2002/0003690 | A1 * | 1/2002 | Lin | H01L 23/467 257/E23.099 |
| 2007/0023420 | A1 * | 2/2007 | Gagas | H05B 6/1263 219/623 |
| 2007/0062513 | A1 * | 3/2007 | Gagas | G01G 3/16 126/299 D |
| 2014/0048057 | A1 * | 2/2014 | Bruckbauer | F24C 15/2035 126/299 D |
| 2018/0306449 | A1 * | 10/2018 | Flesch | F24C 15/2042 |

FOREIGN PATENT DOCUMENTS

| | | | | | |
|---|---|---|---|---|---|
| CN | 202692194 | U | * | 1/2013 | |
| CN | 202733956 | U | | 2/2013 | |
| CN | 107781886 | A | | 3/2018 | |
| CN | 107923631 | A | | 4/2018 | |
| CN | 108302569 | A | | 7/2018 | |
| CN | 207741166 | U | * | 8/2018 | F24C 15/2042 |
| DE | 29612204 | U1 | | 12/1997 | |
| DE | 29813303 | U1 | | 11/1998 | |
| DE | 202013005303 | U1 | * | 8/2013 | F24C 15/10 |
| DE | 202012013527 | U1 | | 8/2017 | |
| DE | 102016113867 | A1 | | 2/2018 | |
| EP | 3338031 | A1 | | 6/2018 | |
| IT | RN20110052 | A1 | | 2/2013 | |
| JP | 2004179056 | A | * | 6/2004 | |
| WO | 2012146237 | A1 | | 11/2012 | |
| WO | 2017029128 | A1 | | 2/2017 | |
| WO | 2018036799 | A1 | | 8/2017 | |

OTHER PUBLICATIONS

German Examination Report, mailed Apr. 30, 2019 in corresponding German Patent Application No. 102018212330.6.

German Examination Report, mailed Jul. 10, 2019 in corresponding German Patent Application No. 102019202089.5.

* cited by examiner

FUME EXTRACTION DEVICE

CROSS-REFERENCES TO RELATED APPLICATIONS

This application claims the priorities of German Patent Applications, Serial No. 10 2018 212 330.6, filed Jul. 24, 2018, Serial No. 10 2018 215 426.0, filed Sep. 11, 22018, and Serial No. 10 2019 202 089.5, filed Feb. 15, 2019, pursuant to 35 U.S.C. 119(a)-(d), the contents of which are incorporated herein by reference in their entirety as if fully set forth herein.

FIELD OF THE INVENTION

The invention relates to a fume extraction device for the downward extraction of cooking fumes. The invention furthermore relates to a stove top system having a fume extraction device of this type. The invention finally relates to a fan for suctioning cooking fumes for a fume extraction device of this type.

BACKGROUND OF THE INVENTION

A fume extraction device for the downward extraction of cooking fumes is known from WO 2012/146 237 A1. The fume extraction device has an inflow opening and a fan which for suctioning the cooking fumes is fluidically connected to the inflow opening. An installation height of the fume extraction device determines an overall installation height of the stove top system having a fume extraction device of this type.

SUMMARY OF THE INVENTION

It is an object of the invention to improve a fume extraction device.

This object is achieved by a stove top system having at least one inflow opening for the inflow of the cooking fumes; and at least one fan for suctioning the cooking fumes at the at least one inflow opening, such fan having a fan propeller that is mounted so as to be rotatable about a rotation axis; wherein the rotation axis is oriented so as to be inclined in relation to a horizontal plane and to a vertical direction. It has been recognized according to the invention that a fume extraction device for the downward extraction of cooking fumes, having at least one inflow opening for the inflow of the cooking fumes, and at least one fan for suctioning the cooking fumes through the at least one inflow opening, wherein the fan has a fan propeller that is mounted so as to be rotatable about a rotation axis, can have one or a plurality of fans having a rotation axis which is oriented so as to be inclined in relation to a horizontal plane and to a vertical direction, so as to have a particularly minor overall installation height and to be able to be integrated in a space-saving manner in a stove top system. Furthermore, a deflection of flow between the inflow opening and the at least one fan can be reduced on account thereof, the extraction of the cooking fumes being able to take place in a particularly energy-efficient manner on account thereof. The statements pertaining to the inclination of the rotation axis relate in particular to all of the fans of the fume extraction device.

The at least one fan is preferably configured as a radial fan. The fan can also be configured as an axial fan or a crossflow fan.

According to a particularly preferred embodiment of the fume extraction device, a negative-pressure duct portion of an exhaust air duct of the fume extraction device protrudes in a downward manner beyond the at least one fan by at most 50 mm, in particular at most 25 mm, in particular at most 10 mm. The at least one fan even more preferably protrudes beyond the negative-pressure duct portion in a downward manner in the vertical direction. A particularly minor installation height of the fume extraction device can thus be guaranteed.

According to a further aspect of the invention, an inclination angle between the horizontal plane and the rotation axis of the at least one fan is in a range from 10° to 85°, in particular in a range from 30° to 80°, in particular in a range from 60° to 75°. The inclination angle can also be exactly 45°.

According to a further aspect of the invention, a suctioning direction of the cooking fumes in the at least one fan has an upward-pointing directional component. An angle between the horizontal plane and the suctioning direction is preferably at least 45°, in particular at least 60°, in particular at least 80°. The fan can be reliably protected against the ingress of liquids on account of the suctioning direction having the upward-pointing directional component.

According to a further aspect of the invention, the negative-pressure duct portion fluidically connects the at least one inflow opening to the at least one fan. A duct centerline of the negative-pressure duct portion along the extent thereof preferably has an absolute angular variation of at most 170°, in particular at most 150°, in particular at most 120°, in particular at most 100°. The absolute angular variation preferably is at least 100°, in particular at least 120°. The absolute angular variation is to be understood to be the integral of an absolute value of a curvature of the duct centerline along the extent thereof. The extraction of the cooking fumes on account thereof can take place in a particularly energy-efficient manner while avoiding turbulences, wherein the at least one fan can be reliably protected against ingressing liquids.

According to a further aspect of the invention, the duct centerline is configured so as to be free of reversal points. Guiding of the cooking fumes in the negative-pressure duct portion can thus take place in particular in a laminar manner.

According to an aspect of the invention, the at least one fan, when viewed in a plan view and in a lateral view and/or in a front view, overlaps the at least one heating unit. The heating unit preferably has a power electronics unit for supplying a heating element with electric power. The at least one fan, in particular a fan propeller of the at least one fan, when viewed in the plan view and in the lateral view and/or in the front view, preferably overlaps the power electronics unit and/or a control unit of the stove top system and/or a user interface of the stove top system. On account thereof, it is advantageously achieved that the stove top system can be configured in a particularly compact manner, in particular in the vertical direction.

According to an independent aspect of the invention, the fan for suctioning cooking fumes has a fan housing having a negative-pressure connector opening, and a fan propeller that is disposed in the fan housing and mounted so as to be rotatable about a rotation axis, wherein the rotation axis conjointly with a connector normal that is oriented so as to be perpendicular to the negative-pressure connector opening encloses a connector angle which is in a range from 10° to 85°, in particular in a range from 30° to 80°, in particular in a range from 60° to 75°. It is advantageously achieved on account thereof that the fan can be connected particularly easily with an initial portion of a negative-pressure duct portion. Intermediate elements for connecting the initial portion to the negative-pressure connector opening can thus be avoided. The fan can thus be used in a particularly cost-efficient manner for a fume extraction device for the downward extraction of cooking fumes and/or for a stove top system.

It has been recognized according to the invention that the stove top system having a food carrier, at least one heating unit, and a fume extraction device for the downward extraction of cooking fumes must have an overall width of at most 600 mm in order to be able to be used and installed in a particularly flexible manner. A stove top system of this type enables the particularly intensive utilization of the space available in a kitchen. A stove top system of this type, in particular by reducing the workspace required, can lead to living space being utilized in an intensive and comfortable manner particularly in urban regions having ever smaller residential units. It is particularly advantageous that a stove top system of this type can be used in a kitchen base unit having a maximum storage space width of 600 mm, on account of which the freedom of design when planning a kitchen is significantly increased.

According to an aspect of the invention, the stove top system has at least two heating units, in particular at least three heating units, in particular at least four heating units. The at least one heating unit can be configured as a radiation heating unit and/or as an induction heating unit and/or as a mass heating unit and/or as a tepan heating unit. The at least one heating unit can in particular be configured for the operation with electric power and/or fuel gas.

According to an aspect of the invention, an overall width of the stove top system having the food carrier, having all of the heating units, and having the fume extraction device, in particular having a fan and/or a negative-pressure duct portion, is at most 600 mm, in particular at most 580 mm, in particular at most 560 mm, in particular at most 500 mm, in particular at most 450 mm, in particular at most 400 mm, in particular at most 350 mm, in particular at most 300 mm. An overall depth of the stove top system having the food carrier, all of the heating units, and the fume extraction device, in particular having the fan and/or the negative-pressure duct portion, is preferably at most 600 mm, in particular at most 550 mm, in particular at most 515 mm, in particular at most 500 mm, in particular at most 450 mm. According to a particularly preferred embodiment, the overall width is at most 560 mm, and the overall depth is at most 515 mm. The overall width of the stove top system is to be understood to be the extent of the stove top system, in particular of the food carrier, in particular in a horizontal plane parallel to the front edge of the stove top system that faces the user. The overall depth is to be understood to be an extent of the stove top system perpendicular to a front edge of the stove top system, in particular of the food carrier, in particular in a horizontal plane, that faces the user.

According to an aspect of the invention, a ratio between the overall depth and the overall width is at least 0.8, in particular at least 0.9, in particular at least 1, in particular at least 1.2, in particular at least 1.5, in particular at least 1.8.

According to a further aspect of the invention, the fume extraction device has an inflow opening through which the cooking fumes can be suctioned. The inflow opening can be disposed so as to be directly adjacent to a peripheral region of the food carrier, or so as to be spaced apart from the latter.

The inflow opening, when viewed in a plan view, can be configured so as to be round, in particular non-circular or circular and/or oval, or in the shape of a polygon, in particular in the form of a triangle, or in the form of a quadrangle, or in the form of a pentagon, or in the form of a hexagon.

According to a further aspect of the invention, the vertical overall installation height of the stove top system, in particular having the food carrier, all of the heating units, and the fume extraction device, in particular having the fan and/or the negative-pressure duct portion, is at most 300 mm, in particular at most 280 mm, in particular at most 250 mm, in particular at most 220 mm, particularly preferably at most 200 mm, in particular at most 180 mm, in particular 160 mm, in particular 150 mm, in particular 120 mm, in particular 100 mm. In principle, the overall installation height may also be larger.

According to a further aspect of the invention, the fume extraction device has at least one, in particular exactly one, at least two, in particular exactly 2, or at least three of the fans for the extraction of the cooking fumes. The stove top system having the food carrier, having all of the heating units, and having the fume extraction device, in particular having the fan and/or having the negative-pressure duct portion, is preferably configured as a combination apparatus. On account thereof, the integral assembly of the stove top system is enabled on a worktop, for example. The complexity in terms of the assembly can be significantly reduced on account thereof.

According to a further aspect of the invention, the stove top system comprises exactly 3 of the heating units. On account of the stove top system having only three of the heating units, the stove top system can be configured with a particularly minor overall width. The stove top system having the three heating units simultaneously offers sufficient flexibility in terms of simultaneously heating different foods.

According to a further aspect of the invention, the at least one inflow opening penetrates the food carrier. It is advantageously achieved on account thereof that the inflow opening is able to be positioned particularly close to the heating units. The cooking fumes can thus be suctioned directly at the location where said cooking fumes are generated. The fume extraction device can also have two or three of four of the inflow openings.

According to a further aspect of the invention, an inflow duct having an initial portion that is directly adjacent to the inflow opening adjoins the at least one inflow opening. The initial portion can have a central longitudinal axis which is configured so as to be inclined in relation to a stove top normal. The stove top normal is understood to be a direction perpendicular to a work area of the stove top, in particular of the food carrier. An angle between the central longitudinal axis and the stove top normal is preferably in a range from 10° to 180°, in particular from 30° to 60°, in particular from 40° to 50°, said angle particularly being exactly 45°.

According to a further aspect of the invention, the fume extraction device has an inflow mesh which is able to be disposed on the at least one inflow opening. The inflow mesh can have at least one baffle element which for the directed extraction of the cooking fumes is oriented in particular in the direction of the at least one heating element. The baffle element can be configured as a baffle plate, in particular as a fin plate. The at least one baffle element preferably does not protrude in an upward manner beyond the food carrier. Alternatively, the baffle element can protrude beyond the food carrier. The inflow mesh herein preferably at least partially surrounds the inflow opening above the food carrier. The at least one baffle element can mask the region of the inflow opening that faces away from the at least one heating unit. To this end, the inflow mesh preferably has a wall which at least in portions masks the inflow opening in the horizontal direction and/or in an upward manner. The inflow mesh is preferably able to be reversibly disposed on the inflow opening.

According to a further aspect of the invention, the inflow mesh does not completely cover the inflow opening. For example, the inflow opening, when viewed in a plan view, can be configured so as to be oval, and the inflow mesh, when viewed in a plan view, can be configured so as to be around. The inflow opening, when viewed in a plan view herein, can completely enclose the inflow mesh. The cooking fumes suctioned through the inflow opening hereby are not entirely but only proportionally directed through the inflow mesh.

According to a further aspect of the invention, a geometric center of area of the at least one inflow opening, when viewed in a plan view, is disposed so as to be spaced apart from a geometric center of area of the food carrier. It is advantageously achieved on account thereof that the stove top system can be configured in a particularly compact manner, in particular in the horizontal direction.

According to a further aspect of the invention, the at least one inflow opening, when viewed in the plan view, is disposed so as to be spaced apart from the geometric center of area of the food carrier in the width direction and/or in the depth direction. On account of the at least one inflow opening not overlapping the geometric center of area of the food carrier, a particularly compact embodiment of the stove top system can be guaranteed.

According to a further aspect of the invention, the stove top system has a plurality of the heating units wherein, when viewed in the plan view, a minimum spacing between the geometric center of area of the food carrier and a first of the heating units is at least double a minimum spacing between the geometric center of area of the food carrier and a second of the heating units. On account thereof, the stove top system can be configured so as to be particularly compact in the horizontal direction. This applies in particular when heating units of dissimilar sizes are used.

According to a further aspect of the invention, at least one of the heating units, when viewed in a plan view, is configured so as not to be circular, in particular so as to be quadrangular, in particular square or rectangular, or triangular or hexagonal, in particular in the form of a regular hexagon. The at least one heating unit and the inflow opening are preferably in each case configured in the shape of a regular hexagon. A particularly compact construction mode is thus enabled. Furthermore, the available area below the food carrier is able to be utilized in a particularly intensive manner. A minimum spacing between all of the heating units is preferably at most 40 mm, in particular at most 20 mm, in particular at most 10 mm.

According to a further aspect of the invention, the spacings between the at least one inflow opening and the respective heating unit differ by at most 50%, in particular at most 30%, in particular at most 10%. When viewed in a plan view, all of the heating units are preferably spaced apart identically from the at least one inflow opening. A uniformly efficient extraction of the cooking fumes above each of the heating units can be reliably guaranteed on account thereof.

According to a further aspect of the invention, a minimum spacing between the at least one inflow opening and the at least one heating unit, when viewed in a plan view, is at most 50 mm, in particular at most 30 mm, in particular at most 10 mm. The extraction of the cooking fumes can thus take place in a particularly energy-efficient manner.

According to a further aspect of the invention, the at least one heating unit, when viewed in a plan view, overlaps the geometric center of area of the food carrier. A configuration of the stove top system that is particularly compact in the horizontal direction is enabled on account thereof.

According to a further aspect of the invention, the stove top system has a user interface for controlling the at least one heating unit and/or the fume extraction device. The user interface, when viewed in a plan view, can be disposed relative to at least one of the heating units in such a manner that said user interface lies opposite the inflow opening. A particularly compact disposal of the at least one heating unit, the inflow opening, and the user interface in the horizontal direction is advantageously guaranteed on account thereof.

The invention is furthermore based on the object of achieving an improved kitchen workspace.

It has been recognized according to the invention that a kitchen workspace must have a kitchen base unit having a storage space which has a storage space width of at most 600 mm, and a stove top system according to the preceding description, wherein the at least one heating unit and the fume extraction device, when viewed in a plan view, are completely disposed within the storage space, in order to guarantee a particularly intensive utilization of the space in a kitchen. The advantages of the kitchen workplace according to the invention correspond to the advantages of the previously discussed stove top system. In particular, the kitchen workspace can be refined using the features of the stove top system.

The storage space in the width direction can be delimited by two vertical partitions which are oriented so as to be mutually parallel. The partitions are preferably mutually spaced apart by at most 600 mm. The stove top system, when viewed in the plan view, is preferably completely disposed between the two partitions. When viewed in a lateral view, at least one of the partitions preferably overlaps the fume extraction device and/or the at least one heating unit. The partitions can be configured for supporting a worktop. The stove top system can be fastened to the worktop.

According to a further aspect of the invention, the kitchen base unit has a rear wall. The rear wall can have a clearance for routing a cooking fume duct, in particular a positive-pressure duct portion that is connected to the stove top system.

According to a further aspect of the invention, the kitchen base unit has a fastening installation for at least proportionally fastening the stove top system or the negative-pressure duct portion.

According to a further aspect of the invention, the kitchen base unit has a divider for delimiting in a downward manner a storage space for the stove top system.

The kitchen base unit can have a thermal insulation and/or a noise insulation. It is advantageously achieved on account thereof that a space situated below the stove top system is reliably protected against an input of heat, and/or that a noise emission, in particular when operating the fume extraction device, is reduced.

The fume extraction device preferably has at least three, in particular at least four, in particular at least five, in particular at least six, in particular at least eight, fans. On account thereof, the fume extraction device can be embodied in a particularly compact manner, thus with a reduced installation space, and be operated in a particularly quiet manner. The at least three fans can be configured as axial fans and/or radial fans and/or crossflow fans. A large number of fans enables the use of comparatively small and/or silent fans while maintaining the extraction output. In comparison to axial fans, crossflow fans with the same extraction output have a smaller diameter and therefore enable particularly compact dimensions of the fume extraction device.

According to an aspect of the invention, the at least one fan has in each case fan propeller having a diameter of at most 250 mm, in particular at most 200 mm, particularly preferably at most 180 mm, in particular at most 150 mm, in particular at most 120 mm, in particular at most 100 mm, in particular at most 80 mm, in particular at most 50 mm. The fume extraction device can thus be configured in a particularly compact manner. The installation space required by the fume extraction device is minor.

In principle, fans having comparatively large fan propellers, in particular having a diameter of 160 mm, 200 mm, or up to 250 mm, can also be used. It is in particular possible to use four fans having fan propellers having a diameter of in each case 160 mm. The fan propellers can in each case have an installation height of 80 mm or less, in particular 50 mm or less.

An installation height of the fume extraction device preferably is at most 220 mm, in particular at most 200 mm, in particular at most 150 mm, in particular at most 120 mm, in particular at most 100 mm. It is advantageously achieved on account thereof that the fume extraction device is able to be configured in a particularly compact manner. A space below the fume extraction device can be largely maintained as a storage space, for example for cooking utensils.

According to a further aspect of the invention, the fan propeller or the fan propellers is/are at least in part from metal, plastics material, or fiber-composite material. Said fan propellers are in particular from a non-melting material that is heat resistant up to at least 50° C. Said fan propellers are in particular from a moisture-resistant and/or dimensionally stable material. The fan propeller is in particular from a non-flammable material. It is in particular from a flame-resistant material.

According to a further aspect of the invention, the at least one fan by way of a negative-pressure duct portion of the fume extraction device is connected to the at least one inflow opening in an aerodynamic manner. The negative-pressure duct portion of the fume extraction device extends between the at least one inflow opening and the at least one fan. All of the fans are preferably connected to one another in an aerodynamic manner by way of the negative-pressure duct portion. The at least one fan can be connected to the at least one inflow opening by way of the single negative-pressure duct portion. Alternatively, the fume extraction device can have a plurality of inflow openings, wherein each of the inflow openings is aerodynamically connected to one of the fans by way of a separate negative-pressure duct portion. All of the fans are preferably actuatable in a mutually independent manner, in particular by means of a corresponding control installation. The cooking fumes can thus be preferably extracted in a mutually independent manner by way of the individual inflow openings. In order for the extraction output to be varied, all or some of the fans can be selectively activatable. The individual fans can thus at all times be operated at an optimal rotating speed which is determined in particular by the geometry of the fan propellers and at which said fan propellers operate in an efficient and silent manner, wherein the extraction output remains controllable by activating a reduced number of fans in comparison to the total number of fans.

The fume extraction device can have a filter for filtering the cooking fumes. On account of a plurality of the fans being aerodynamically connected to one another by way of the negative-pressure duct portion, a number of filters may be less than the number of fans. The fume extraction device can thus be embodied in a compact manner and so as to be simple to service. The fume extraction device is preferably configured in such a manner that each of the fans extracts the cooking fumes through each of the filters, in particular through a single filter.

According to a further aspect of the invention, the filter in the vertical direction is disposed so as to be adjacent to the at least one inflow opening and/or food carrier, in particular a surface of the food carrier, and/or is disposed so as to be flush with the surface of the latter. The filter, when viewed in a plan view, can be completely overlapped by the food carrier or be disposed behind the food carrier. On account of a disposal of the filter of this type, the fume extraction device can be configured in a particularly space-saving manner and have a particularly minor installation height.

The filter can be adhesively bonded to the food carrier and/or by way of a filter receptacle, be connected to the food carrier, in particular in a form-fitting manner, in particular by way of a rail. The filter is preferably reversible, in particular able to be removed without tools, from the fume extraction device, in particular from the food carrier. The filter can be configured as a grease filter. An area of the filter which, when viewed in a plan view, is covered by the food carrier is preferably at least 50% of the area of the food carrier when viewed in the plan view. Energy-efficient filtering of the cooking fumes is thus guaranteed.

The fume extraction device can have at least one cover for covering the at least one inflow opening. The cover can be disposed so as to be parallel to a surface of the food carrier, in particular so as to be flush with the surface of the latter. The cover can have a plurality of, in particular at least ten, in particular at least fifty, in particular at least one hundred, cover openings for extracting the cooking fumes. The cover can be configured as a mesh or as a knitted metal mesh. The cover can comprise glass, in particular glass ceramics, or a metal, in particular stainless steel. The cover, in particular in terms of color and/or structure, is preferably adapted to the food carrier in such a manner that said cover and said food carrier, if at all, are barely able to be visually distinguished from one another.

The filter can comprise the at least one cover and at least one filter element. The cover can be reversibly connected to the filter element. The filter can have a collection tray for receiving overflowing liquids. The filter is triangular in the cross section, for example.

According to an aspect of the invention, the fume extraction device has at least one fan motor which, in a rotationally driven manner, is in each case connected to at least two, in particular to at least three, of the fans. All of the fans are preferably rotationally driven by means of a single fan motor. To this end, the fan motor by way of one or a plurality of rotation-transmitting means, in particular one or a plurality of transmissions and/or a belt drive, can be connected in a rotation-transmitting manner to the respective fan propeller of the at least two, in particular at least three, fans. The fan motor can be connected in a rotation-transmitting manner to the fan propellers of the fans, or be decoupled from the latter, in particular by way of a switchable clutch installation. In general, the number of fan motors can be less than the number of fans, in particular less than the number of fan propellers. This aspect is also advantageous independently of the other details of the present invention.

According to a further aspect of the invention, the fume extraction device comprises at least one odor filter, in particular an activated carbon filter, that is disposed in the negative-pressure duct portion. The filter is preferably configured as a combination filter, wherein said combination filter comprises a grease filter as well as an odor filter. The odor filter disposed in the negative-pressure duct portion is able to be reversibly removed in a particularly simple manner, in particular by way of the at least one inflow opening. The fume extraction device is thus particularly simple to service.

According to a further aspect of the invention, at least two of the fans have rotation axes which are oriented so as to be mutually oblique. This is to be understood such that at least two of the fans have rotation axes which are not mutually parallel. The rotation axis of the at least one fan can be oriented so as to be vertical and/or horizontal. The rotation axis of the at least one fan can also be disposed so as to be inclined in relation to the vertical direction, wherein an angle in relation to the vertical direction is more than 5° and less than 85°. The rotation axes of the at least two fans can be oriented so as to be radial in relation to the negative-pressure duct portion disposed upstream and/or to a vertical axis that runs in particular through the geometric center of area of the inflow opening. The at least two fans can thus be disposed in a particularly space-saving manner on the negative-pressure duct portion. An angle between the rotation axes of the at least two fans is preferably at least 30°, in particular at least 45°, in particular 90°.

According to a further aspect of the invention, the fume extraction device comprises at least one baffle element which for masking one side of an upper space that lies upstream of the at least one inflow opening is adjacent to the at least one inflow opening and able to be repositioned along a vertical direction. An upper space is understood to be a space above the fume extraction device from which the cooking fumes are extracted downward by means of the fume extraction device. The baffle element is preferably configured in a plate-shaped manner. The at least one baffle element surrounds the at least one inflow opening on one side, that is to say not completely. When viewed in the plan view, the at least one baffle element surrounds the at least one inflow opening, in particular proceeding from a geometric center of area of the inflow opening, preferably across an angle of at least 30°, in particular at least 45°, in particular at least 90°, in particular at least 120°, in particular at least 180°. The extraction of the cooking fumes can thus take place in a directed and particularly energy-efficient manner.

The effectiveness of the baffle element depends substantially on the height of the latter. The at least one baffle element in the vertical direction, proceeding from the at least one inflow opening, extends upward across at least 50 mm, in particular at least 100 mm, in particular at least 150 mm, in particular at least 200 mm.

The at least one baffle element can be configured so as to be flat or curved once or curved twice, that is to say not be able to be developed. The at least one baffle element in the cross section is preferably configured in an arcuate manner.

The at least one baffle element can have an illumination. The at least one baffle element can also have a user interface for controlling the at least one fan and/or the at least one stove top.

The at least one baffle element is preferably repositionable relative to the at least one inflow opening. To this end, the fume extraction device can have a guide installation, in particular a gate guide. The at least one baffle element is preferably able to be disposed in a directing position, in which the upper space is masked on one side, and a restoring position, in which the extraction of the cooking fumes takes place so as to be unimpeded by the at least one baffle element.

According to a further aspect of the invention, an upper side of the at least one baffle element in the restoring position is able to be disposed below, or so as to be flush with, the inflow opening, that is adjacent thereto. A region above the inflow opening can thus be used for placing food in a manner unimpeded by the at least one baffle element.

The baffle element preferably comprises a closure element for closing the at least one inflow opening, in particular in an air-tight manner, in the restoring position.

When viewed in a plan view, the at least one baffle element in the directing position preferably at least partially covers the at least one inflow opening. The extraction of the cooking fumes can thus take place in a more directed and thus particularly efficient manner.

According to a further aspect of the invention, the at least one inflow opening has an area of at most 100 $mm^2$, in particular at most 10 $mm^2$, in particular at most 1 $mm^2$, in particular at most 0.1 $mm^2$. The number of inflow openings is preferably at least ten, in particular at least twenty-five, in particular at least fifty, in particular at least one hundred, in particular at least one thousand. The extraction of the cooking fumes can thus take place at a multiplicity of different positions and so as to be in direct proximity to the location where the cooking fumes are created. The extraction of the cooking fumes is thus particularly efficient.

According to a further aspect of the invention, the numerous inflow openings are associated to in each case one of at least two extraction sections, wherein the extraction of the cooking fumes can take place independently by way of each of the extraction sections. The inflow openings of each of the at least two extraction sections can in each case be connected to negative-pressure duct portions that are present so as to be mutually separated in an air-tight manner. Each of the at least two extraction sections, in particular by way of in each case one separate negative-pressure duct portion, is preferably aerodynamically connected to in each case at least one fan for suctioning the cooking fumes. Each of the at least two extraction sections preferably comprises at least one, in particular at least two, in particular at least five, in particular at least ten, in particular at least fifty, inflow openings.

A further object of the invention lies in improving a stove top system.

This object may be achieved by a stove top system having a fume extraction device according to the preceding description and a stove top for heating food. The advantages of the stove top system according to the invention correspond to the advantages of the fume extraction device described above. The stove top preferably comprises at least one food carrier and at least one heating unit disposed below the food carrier. The at least one heating unit can be configured as a radiation heating unit and/or as an induction heating unit. The at least one heating unit, in particular the induction coils, can in each case have a diameter, or a length and width, respectively, of up to 23 cm, in particular up to 24 cm, in particular more than 24 cm. The stove top system can in particular have four stove tops having a diameter, or a length and width, respectively, of in each case 24 cm.

The at least one inflow opening, when viewed in a plan view, is preferably disposed in the rear third, in particular in the rear quarter, of the stove top system. The at least one inflow opening preferably extends across at least 50%, in particular at least 70%, in particular at least 85%, of the width of the stove top system.

When viewed in a plan view, the food carrier according to an aspect of the invention completely overlaps all of the fans. The horizontal dimensions of the stove top system are thus particularly minor.

According to a further aspect of the invention, the fans, when viewed in a plan view, are disposed in a region behind the rearward edge of the food carrier. This enables the stove top system to be configured having a particularly minor installation height in the front region, in particular in the region of the stove tops, which are also referred to as cooktops. The stove top system in the front region, in particular across at least 50%, in particular at least 70%, in particular at least 80%, in particular at least 90%, of the extent thereof in the direction perpendicular to the front edge can have an installation height of at most 10 cm, in particular at most 5 cm, in particular at most 4 cm. These statements pertaining to the installation height of the stove top system apply in particular to the entire region in which the stove tops are disposed. The stove top system in this region thus has a minor installation height of such a type that the entire space in the base unit situated therebelow is utilizable. The top drawer in particular does not have to be dispensed with. The latter can optionally be configured with a somewhat reduced insertion depth.

According to a further aspect of the invention, the stove top system has an L-shaped cross section. Said stove top system, in particular in the front region thereof, in particular in the region where the stove tops are disposed, can have an installation height that is smaller than in the region of the rearward edge of said stove top system. For example, electronic components and/or the fan or fans, in particular the fan propeller or fan propellers, herein can be disposed in the region of the rearward edge.

According to a further aspect of the invention, the stove top system can have a cross-section that is L-shaped in the transverse direction. Said stove top system in one or both of the peripheral regions thereof can in particular have a larger installation height than in the central region of said stove top system. It may also be achieved on account thereof that the stove top system in the central region thereof has a particularly minor installation height. It is in particular possible for electronic components and/or fans or the components thereof, and/or other components of the stove top system to be disposed in a peripheral region, in particular in a rear and/or a lateral peripheral region.

According to an aspect of the invention, the filter, when viewed in the plan view, is disposed between at least two of the stove tops, or behind the at least one stove top.

According to an aspect of the invention, the at least one inflow opening is configured so as to be gas-permeable and liquid-repellent, in particular liquid-tight. To this end, a gas-permeable and liquid-repellent, in particular liquid-tight, layer can be disposed on the at least one inflow opening, in particular on the food carrier. The gas-permeable and liquid-repellent layer can be disposed above or below the food carrier. The gas-permeable and liquid-repellent layer can be attached, in particular in a materially integral or interchangeable manner, on the food carrier and/or on the at least one filter. The gas-permeable and liquid-repellent layer is preferably configured so as to be able to be cleaned, in particular so as to be dishwasher safe. It may be achieved on account thereof that cooking fumes are reliably suctioned downward but liquids cannot invade a region below the food carrier and/or the at least one inflow opening.

The at least one inflow opening can in each case delimit upstream an inflow duct which penetrates the food carrier. The at least one inflow duct can be configured as a bore, in particular as a microbore and/or a perforation. At least one of the inflow openings, when viewed in the plan view, is preferably disposed in a central region of the food carrier, in particular in the region of the geometric center of area of the food carrier. At least one of the inflow openings, when viewed in a plan view, can be disposed in a peripheral region of the food carrier.

According to an aspect of the invention, the proportion in terms of area of a perforated surface of the food carrier in relation to the overall surface of the food carrier, when viewed in a plan view, is at least 30%, in particular at least 50%, in particular at least 75%, in particular 100%.

According to an aspect of the invention, the at least one food carrier, is able to be reversibly removed, in particular without tools, from a food carrier receptacle of the stove top system.

The food carrier can in particular be configured as a separate construction element which can be separated from the other component parts of the stove top system. Said food carrier can also be able to be separated, in particular be able to be removed, conjointly with the induction generators from the other component parts of the stove top system.

The food carrier can be configured so as to be dishwasher safe and/or for cleaning by a pyrolysis method. To this end, the food carrier can in particular be configured so as to be resistant to scratches and/or corrosion and/or heat, in particular for temperatures of at least 200° C., in particular at least 300° C., in particular at least 400° C., in particular at least 500° C.

The at least one food carrier can also be configured as capacitively and/or electrically heatable hot plate which is in particular removable without tools and/or portable. For electrical heating, the hot plate can have layers of micanite. The hot plate is preferably able to be heated up to a temperature of at most 120° C., in particular at most 100° C., in particular at most 80° C. The food carrier preferably has a specific thermal capacity of at least 500 J/kgK, in particular at least 700 J/kgK, in particular at least 850 J/kgK.

According to a further aspect of the invention, the stove top system is configured as a compact apparatus. A compact apparatus is understood to be an assembly unit comprising the stove top and the fume extraction device, wherein the fume extraction device comprises the negative-pressure duct portion and the at least one fan. The stove top system configured as a compact apparatus is able to be assembled in particular on a worktop in a manner which is particularly rapid and favorable in terms of complexity.

According to a further aspect of the invention, the at least one fan, when viewed in a plan view, is horizontally disposed completely behind the geometric center of area of the stove top system, in particular of the food carrier. An overall installation height of the stove top system can thus be particularly minor. When the stove top system is attached to a kitchen base unit, the storage space available below the worktop, in particular in a front region, remains largely unimpeded by the stove top system. The at least one fan, when viewed in the plan view, is preferably disposed completely in a region behind the food carrier. A rotation axis of the at least one fan herein can be oriented so as to be horizontal, in particular in the depth direction of the stove top.

According to a further aspect of the invention, a front installation height of the stove top system, in a horizontal region between the front edge and a geometric center of area of the stove top system, is at most 180 mm, in particular at most 150 mm, in particular at most 120 mm, in particular at most 100 mm, in particular at most 80 mm, in particular at most 50 mm. It has been demonstrated that a stove top system having an installation height of 40 mm in the front region is possible.

The stove top system has a minor installation height of this type in particular in a region which, proceeding from the front edge, extends in a direction perpendicular to the latter across at least 30 cm, in particular at least 40 cm, in particular at least 50 cm.

The stove top system can have a minor installation height of this type in particular in the entire region of the cooktops.

An overall installation height of the stove top system is preferably at most 250 mm, in particular 200 mm, in particular 150 mm.

The invention is furthermore based on the object of improving a stove top system having a stove top cover.

It has been recognized according to the invention that the stove top system having the stove top cover which is able to be repositioned relative to the stove top and which, when viewed in a plan view, in the closed position at least partially covers and in the open position exposes the at least one inflow opening and the at least one cooktop is able to be utilized in a particularly flexible and intensive manner. A region above the food carrier in which the at least one heating unit heats the food is referred to as a cooktop.

When the stove top cover is disposed in the open position, the entire cooktop can be used in the usual manner for heating the food. When the stove top cover is disposed in the closed position, a first region above the cooktop can be utilized for heating food, for example, wherein a second region above the cooktop can simultaneously be used for preparing the food. By covering the at least one inflow opening at least in portions, the extraction intensity is increased in the non-covered region of the inflow opening while the fan output remains unchanged. An increased extraction output can thus be provided in that region of the cooktop that is used for cooking. Moreover, the stove top cover disposed in the open position can reliably protect a wall lying therebehind against grease splatters. An intensive utilization of the space available in a kitchen and an energy-efficient extraction of cooking fumes are thus enabled.

According to a further aspect of the invention, the stove top cover in the closed position covers only the at least one inflow opening but not the cooktops. The stove top cover in the closed position can adjoin a rear edge of the stove tops, in particular of the food carrier, in particular so as to be flush with said rear edge.

An upper side of the stove top cover can be configured as the mechanically resistant, in particular scratch-resistant, storage surface and/or a cut-resistant cutting surface. When the stove top cover is disposed in the closed position, the upper side of the stove top cover can then be utilized for preparing food stuff to be heated, for example. The stove top cover is preferably highly temperature resistant, in particular to temperatures of at least 150° C., in particular at least 200° C., in particular at least 250° C. The stove top cover can have a particularly low thermal conductivity of at most 3.0 W/mK, in particular at most 2.0 W/mK, in particular at most 1.0 W/mK. Heated food can thus be placed on the stove top cover without the risk of damaging the stove top cover and without the risk of burning the skin on the heated stove top cover.

The stove top cover can in particular be from metal, in particular cast iron, glass, or glass ceramics, or from plastics material.

The stove top cover is preferably attached so as to be pivotable on the stove top system, in particular on the stove top. The stove top cover can be connected to a drive installation for repositioning the stove top cover between the closed position and the open position. The drive installation can comprise a motor and/or a spring element. The stove top cover can thus be repositioned in a particularly simple, in particular automated, manner between the closed position and the open position. The stove top cover can have a gripping means for the manual repositioning between the open position and the closed position.

The stove top cover in the closed position preferably completely covers the at least one inflow opening and/or the at least one cooktop. The stove top cover in the closed position, when viewed in a plan view, can completely overlap the entire stove top, in particular the entire food carrier. The stove top cover in the closed position can bear on the stove top, in particular on the food carrier. In the closed position, a surface of the stove top cover can be disposed so as to be flush with a worktop or protrude upward beyond the latter.

According to an aspect of the invention, the stove top cover in the closed position closes the at least one inflow opening in an air-tight manner. To this end, the stove top cover can have a closure seal. In the closed position, the closure seal preferably completely surrounds the at least one inflow opening. The exit of odors from the fume extraction device through the at least one inflow opening can thus be reliably prevented, in particular in the case of deactivated fans.

According to a further aspect of the invention, the stove top cover comprises at least two cover members which are able to be repositioned in a mutually independent manner. The at least one inflow opening and the food carrier are preferably in each case able to be partially covered by the at least two cover members. Regions of the food carrier that are not in use can thus be covered conjointly with an in particular adjacent sub-region of the at least one inflow opening, wherein a further sub-region of the food carrier can in particular be used for heating food. The cooking fumes can be extracted in a particularly intensive manner by way of the thus decreased region of the inflow opening.

The stove top cover can have at least one closure lid that is attached to the at least one cover member. The closure lid can be configured in such a manner that the latter in the closed position of the at least one cover member invades a negative-pressure duct portion of the fume extraction device. The closure seal is preferably disposed on the at least one closure lid. The at least one entry opening can thus be closed in a particularly reliable, in particular air-tight, manner.

Further features, advantages, and details of the invention are derived from the description hereunder of the food carrier, the stove top, and the stove top system on the basis of the figures.

DESCRIPTION OF THE PREFERRED EMBODIMENTS

Figure 1:
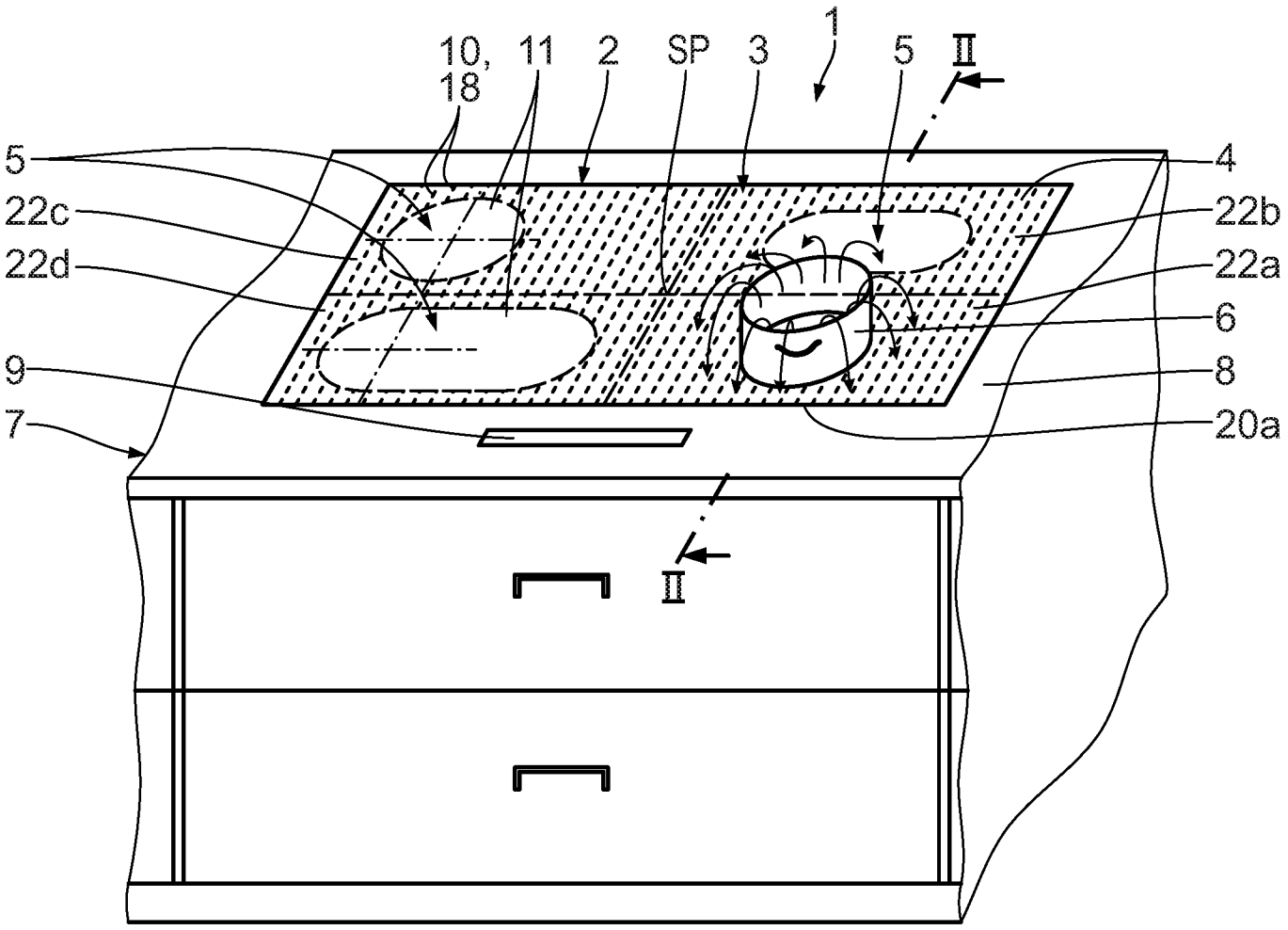
FIG. 1 shows a perspective illustration of a stove top system having a stove top and a fume extraction device.

Various details of a stove top system 1 having a stove top 2 and a fume extraction device 3 will be described hereunder on the basis of FIG. 1 and FIG. 2. The stove top 2 comprises a food carrier 4 having four heating units 5 which for heating food 6 are disposed on said food carrier 4. The stove top system 1 is disposed on a kitchen base unit 7. To this end, the stove top system 1 is fastened to a worktop 8 of the kitchen base unit 7. A surface of the food carrier 4 herein is disposed so as to be flush with a surface of the worktop 8.

The stove top system 1 comprises a user interface 9 for controlling the fume extraction device 3 and the heating units 5. The user interface 9 is configured as a touch-sensitive screen. The user interface 9 is connected in terms of signals to the fume extraction device 3 and the heating units 5 by way of the control unit which is not illustrated.

The food carrier 4 comprises a glass plate, in particular a glass-ceramics plate. The glass plate is penetrated by a multiplicity of inflow ducts 10 for extracting the cooking fumes. A cross-sectional area of the inflow ducts 10 is in each case less than 1 $mm^2$.

A region which is level or above the food carrier 4 and is able to be heated by the respective heating unit 5 forms one cooktop 11. The respective heating unit 5 can act on the food 6 in the region of the cooktops 11 and heat said food. The food carrier 4 in the region of the cooktops 11 does not have any inflow ducts 10. With the exception of the region of the cooktops 11, when viewed in a plan view, the inflow ducts 10 are disposed so as to be distributed in a mutually equidistant manner on the food carrier 4. The inflow ducts 10 extend in each case in a rectilinear manner and in the vertical direction through the food carrier 4. The inflow ducts 10 have a circular cross section.

Figure 2:
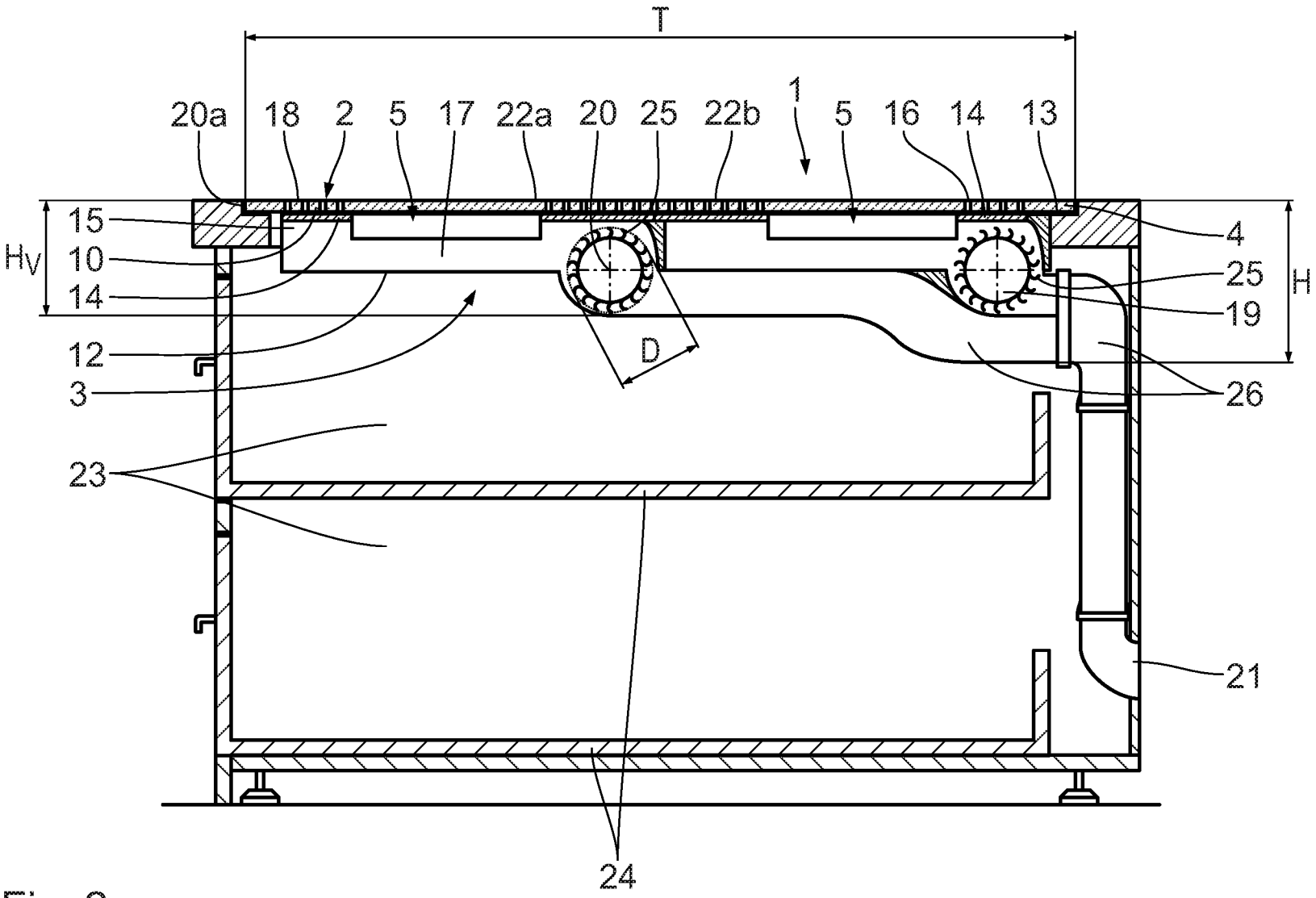
FIG. 2 shows a sectional illustration of the stove top system along the section line II-II in FIG. 1.

As is illustrated in FIG. 2, the stove top system 1 has a housing 12. A food carrier receptacle 13 is disposed on the housing 12. The food carrier 4 bears from above on the food carrier receptacle 13 and is able to be reversibly removed from the latter without tools in an upward manner. The food carrier receptacle 13 has a tilting edge which is not illustrated. The tilting edge delimits a contact face of the food carrier receptacle 13 in relation to a depression. The depression is configured in such a manner that raising a region of the food carrier 4 that lies opposite the tilting edge may be achieved by stressing the food carrier 4 in a downward manner in a region above the depression.

The food carrier 4 is configured so as to be dishwasher safe. The food carrier 4 is in particular configured so as to be highly temperature resistant, in particular to temperatures of at least 350° C., and suitable for cleaning by pyrolysis.

The number of inflow ducts 10 that penetrate the food carrier 4 exceeds 50. A filter 14 is disposed below the food carrier 4, in particular in the regions that are penetrated by the inflow ducts 10. The filter 14, when viewed in a plan view, completely overlaps the inflow ducts 10. The filter 14 is configured as a combination filter for filtering grease and odor from the cooking fumes. The food carrier 4 has a filter receptacle 15. The filter 14 by means of the filter receptacle 15 is reversibly attached to the food carrier 4.

The food carrier 4 is configured so as to be permeable to gases and impermeable to liquids. To this end, the food carrier 4 in the region of the inflow ducts 10 has a hydrophobic surface coating 16.

The filter 14 is disposed in a negative-pressure portion 17 of the fume extraction device 3. The negative-pressure duct portion 17 extends between inflow openings 18, which are configured by the inflow ducts 10 on the upper side of the food carrier 4, and fans 19 of the fume extraction device 3. The fume extraction device 3 comprises four fans 19. The fans 19 are configured as crossflow fans. A rotation axis 20 of the respective fan 19 is oriented so as to be horizontal, in particular so as to be parallel to a front edge 20*a* of the stove top system 1. The fans 19 by way of the negative-pressure duct portion 17 are fluidically connected to the inflow openings 18, and by way of a positive-pressure duct portion 21 are fluidically connected to a cooking fumes outlet 21.

The fume extraction device 3 is configured for extracting cooking fumes by way of four extraction sections 22*a*, 22*b*, 22*c*, 22*d* which are able to be operated in a mutually independent manner. To this end, the respective extraction section 22*a*, 22*b*, 22, 22*d* is in each case connected to one of the fans 19 by way of a separate negative-pressure duct portion 17. The surface of the food carrier 4 is sub-divided into four extraction sections 22 of identical area.

Sealing elements (not illustrated) for connecting in an air-tight manner the negative-pressure duct portion 17 disposed downstream of the respective extraction section 22 to the food carrier 4 are disposed on the negative-pressure duct portion 17. The sealing elements herein completely border the respective extraction section 22.

The food carrier 4 has a depth T of 500 mm. The stove top system 1 in the front region, in particular across at least 70% of the depth T proceeding from a front edge 20*a* of the stove top system 1, has a front installation height Hv of 120 mm or less. The installation height HV of the stove top system 1 in this region can in particular be in the range of only 3 cm to 5 cm. A storage space 23 of the kitchen base unit 7 remains largely unimpeded by the stove top system 1 and free of any installations of the latter. A top drawer 24 of the kitchen base unit 7 herein is shortened neither in the vertical direction nor in the depth direction. It is optionally possible for the top drawer 24 of the kitchen base unit 7 to be configured so as to be somewhat shorter in the depth direction so as to have sufficient space for disposing the fan 19 in the rear region.

The fans 19 have in each case one fan propeller 25. A diameter D of the fan propellers 25 is 80 mm.

The stove top system 1 is configured as a compact apparatus and as a preassembled system can thus be inserted into the worktop 8 in a simple and rapid manner. The stove top system 1 configured as a compact apparatus herein comprises the housing 12, the stove top 2, and the fume extraction device 3, wherein the negative-pressure duct portion 17 and the fans 19 of the fume extraction device 3 are completely associated with the compact apparatus, but the positive-pressure duct portion 26 disposed downstream of the fans 19 is only partially associated with said compact apparatus.

The functional mode of the top stove system 1, the fume extraction device 3, the stove top 2, and the food carrier 4 is as follows:

Putting the stove top system 1 in operation takes place by way of the user interface 9. User inputs for controlling the heating units 5 and the fans 19 are transmitted to the control unit by way of the user interface 9. Electric power for operating the heating units 5 and the fans 19 is provided by means of the control unit. Status and output data of the heating units 5 and of the fans 19 are transmitted to the user interface 9 by way of the control unit, and visually displayed by way of the user interface 9.

The heating units 5 as well as the fans 19 can be provided with an electric output in a mutually independent manner by means of the control unit. By activating the heating unit 5 disposed in the region of the extraction section 22*a*, the food 6 disposed there is exclusively heated. By activating the fan 19 that is connected to the extraction section 22*a*, cooking fumes are extracted by way of the inflow ducts 10 associated with the extraction section 22*a*.

A further exemplary embodiment of the stove top system 1 according to the invention will be described hereunder on the basis of FIG. 3. As opposed to the preceding exemplary embodiment, the inflow ducts 10 are disposed in a non-homogenous manner across a surface of the food carrier 4. Moreover, inflow ducts 10 are also disposed in the region of the cooktops 11. The negative-pressure duct portion 17 herein extends in particular between the heating unit 5 and the food carrier 4. To this end, the heating unit 5 is disposed so as to be spaced apart from the food carrier 4. A number of inflow ducts 10 per unit area in a peripheral region of the respective cooktop 11 is larger than in a central region of the respective cooktop 11, and larger than in the peripheral region of the food carrier 4. A cross-sectional area of the inflow ducts 10 varies so as to correspond to the position of the respective inflow duct 10 relative to the cooktop 11. The inflow ducts 10 that are disposed in a peripheral region of the cooktop 11 have a larger cross-sectional area than those inflow ducts 10 in the central region of the cooktop 11 and in the peripheral region of the food carrier 4.

The inflow ducts 10 are configured so as to be permeable to gases and liquids. A collection tray 27 for overflow liquids is disposed below the food carrier 4. When viewed in a plan view, the collection tray 27 overlaps a multiplicity of the inflow ducts 10.

The stove top system 1 comprises six stove tops 2 having in each case one food carrier 4. The food carriers 4 of the respective stove tops 2 are configured in a mutually separate manner.

Figure 3:
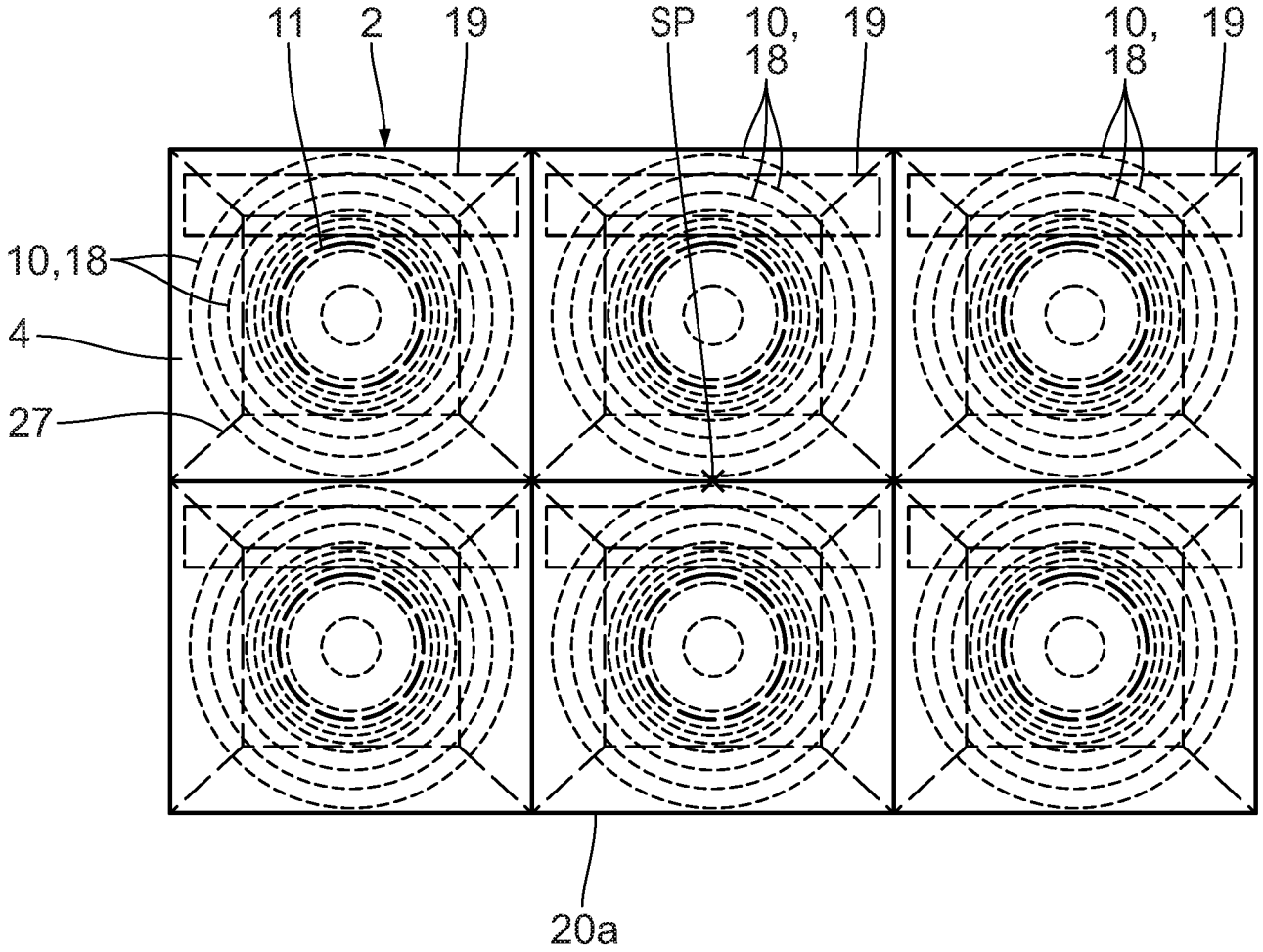
FIG. 3 shows a plan view onto a stove top system according to a further exemplary embodiment, according to which the stove top system comprises six inductive heating units, a fume extraction device having a plurality of cross-flow fans, and a food carrier having a multiplicity of inflow ducts, wherein the latter are distributed in a non-homogenous manner across a surface of the food carrier.

The functional mode of the stove top system 1 according to the exemplary embodiment illustrated in FIG. 3 corresponds to the functional mode of the stove top system 1 according to the above-described exemplary embodiment. On account of the stove top system 1 having a plurality of stove tops 2 having only a single heating unit 5, the dimensions of the food carriers 4 are correspondingly minor. The food carriers 4 can thus be removed from the respective food carrier receptacle 13 in a particularly simple manner and be cleaned in particular in a dishwasher.

Upon the retrieval of the food carriers 4 from the respective food carrier receptacle 13, the collection trays 27 can be easily cleaned from above. The filter 14 disposed on the respective food carrier 4 can be cleaned or replaced in a particularly simple manner.

Figure 4:
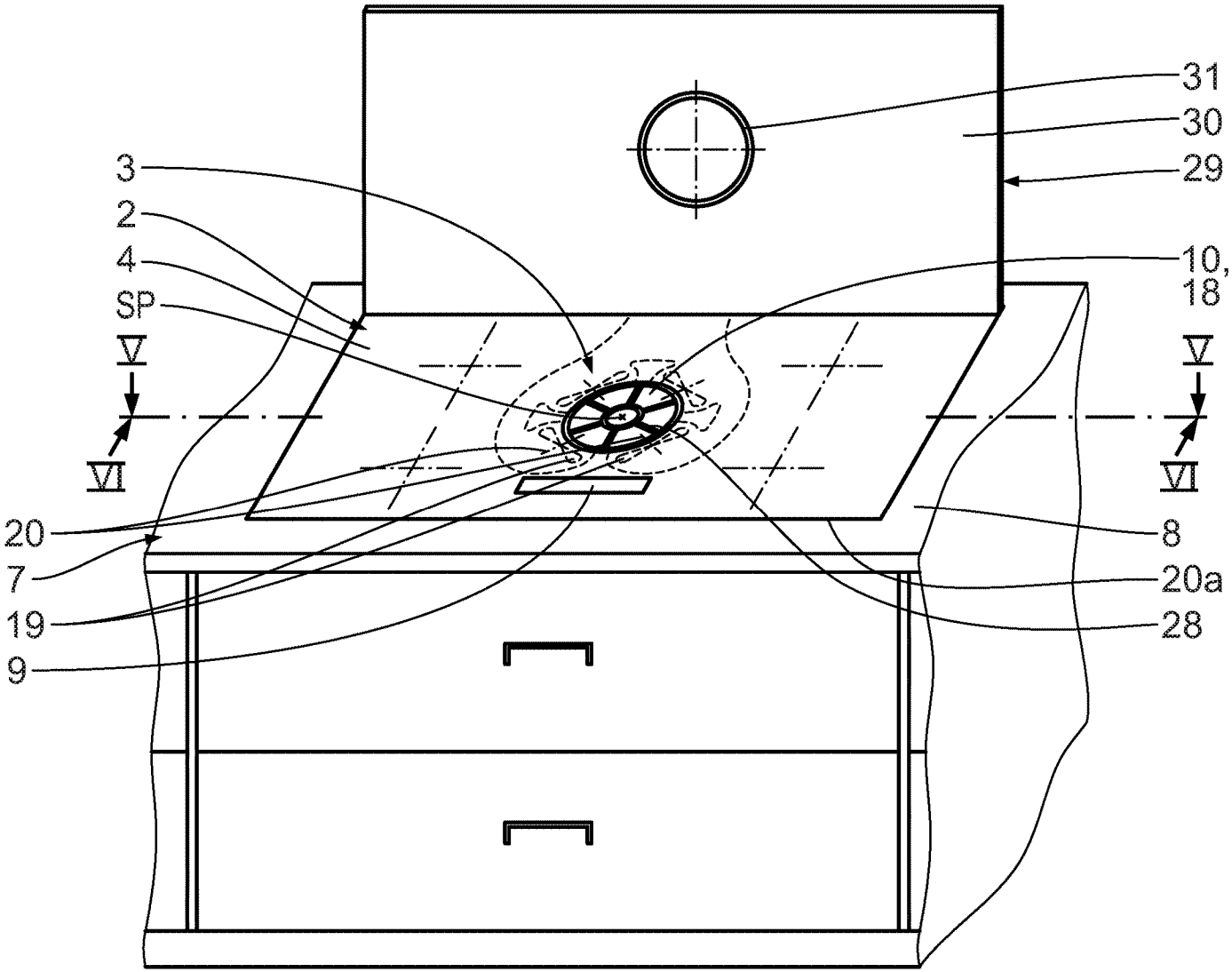
FIG. 4 shows a perspective illustration of a stove top system according to a further exemplary embodiment, comprising a fume extraction device having a single inflow opening configured by a food carrier, and a stove top cover for reversibly and completely covering the food carrier and the inflow opening.
Figure 5:
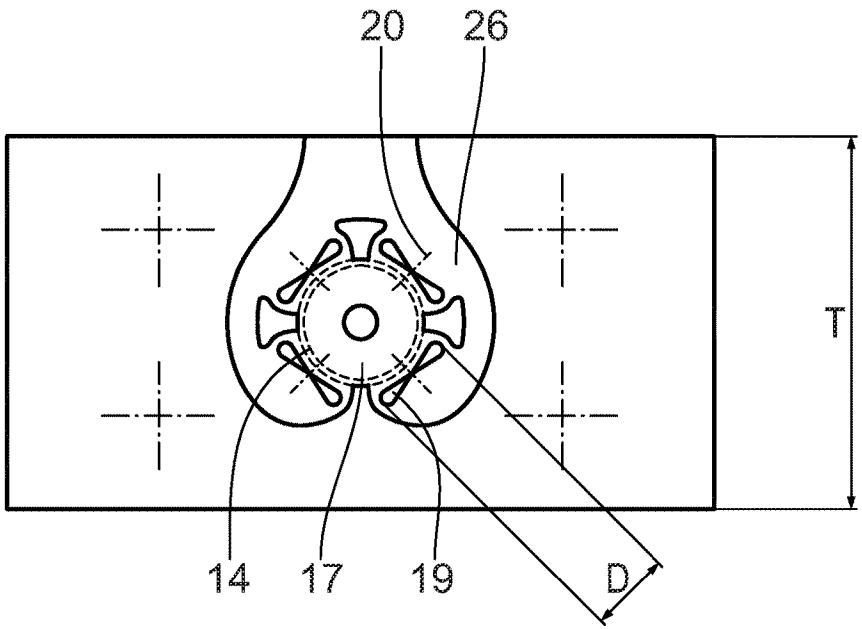
FIG. 5 shows a sectional illustration of the stove top system along the section line V-V in FIG. 4, having four fans which are disposed in an equiangular and equidistant manner about a vertical axis that runs through a center of area of the inflow opening.
Figure 6:
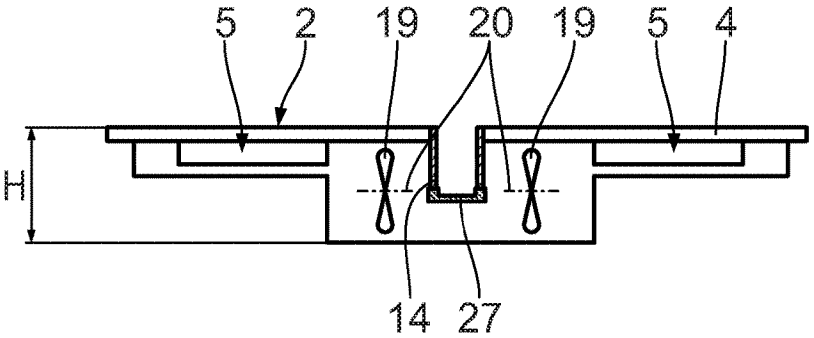
FIG. 6 shows a sectional illustration of the stove top system along the section line VI-VI in FIG. 4, having a hollow-cylindrical filter.

A further exemplary embodiment of the invention is described by means of FIG. 4 to FIG. 6. As opposed to the above-described exemplary embodiments, the food carrier 4 has a single inflow duct 10. An upper side of the inflow duct 10 forms the single inflow opening 18 of the fume extraction device 3. The inflow opening 18 is covered by an inflow mesh 28.

The stove top system 1 comprises a stove top cover 29 for reversibly covering the food carrier 4 and the inflow opening 18. The stove top cover 29 comprises a cover member 30 which is able to be repositioned relative to the food carrier 4. The cover member 30 is able to be disposed in a closed position and in an open position. When viewed in a plan view, the cover member 30 in the closed position completely covers the food carrier 4 and the inflow opening 18. The cover member 30 comprises a closure seal 3 for closing the inflow opening 18 in an air-tight manner in the closed position.

The stove top cover 29 is attached to the stove top 2 in an articulated manner. The stove top cover 29 in the open position exposes the food carrier 4, in particular the cooktops 11, for heating the food, as well as the inflow opening 18 for extracting cooking fumes.

The surface of the food carrier 4 is disposed so as to be flush with the surface of the worktop 8. The cover member 30 in the closed position bears peripherally on the worktop 8. According to an alternative variant of embodiment (not illustrated) the surface of the food carrier 4 can be disposed below the surface of the worktop 8, and a surface of the stove top cover 29 in the closed position can be disposed so as to be flush with the surface of the worktop 8.

FIG. 5 shows a section of the stove top system 1 from below. The fume extraction device 3 of the stove top system 1 comprises four fans 19. The fans 19 have a horizontally oriented rotation axis 20. The fans 19, when viewed in a plan view, are disposed in an equidistant and equiangular manner about a vertical axis that runs through a center of area of the inflow opening 18. The rotation axis 20 of in each case two mutually neighboring fans 19 are mutually oriented at an angle of 90°. The diameter D of the fan propellers 25 is 120 mm. The fans 19 are configured as axial fans.

The fans 19 are connected to the inflow opening 18 by way of a common negative-pressure duct portion 17. The fume extraction device 3 comprises a positive-pressure duct portion 26 that fluidically connects the fans 19.

As is illustrated in FIG. 6, an overall installation height H of the stove top system is 150 mm. A hollow-cylindrical filter 14 having a collection tray 17 for overflowing liquids is disposed downstream of the inflow opening 18. The filter 14 is configured as a grease filter.

The functional mode of the stove top system 1 according to the exemplary embodiment illustrated in FIG. 4 to FIG. 6 corresponds to the functional mode of the stove top system 1 according to the preceding exemplary embodiments. The inflow mesh 27 is able to be reversibly removed from the food carrier 4. The filter 14 can be removed from the inflow opening 18. The stove top cover 29 can be pivoted between the closed position and the open position. The food carrier 4 is fixedly connected to the worktop 8.

Figure 7:
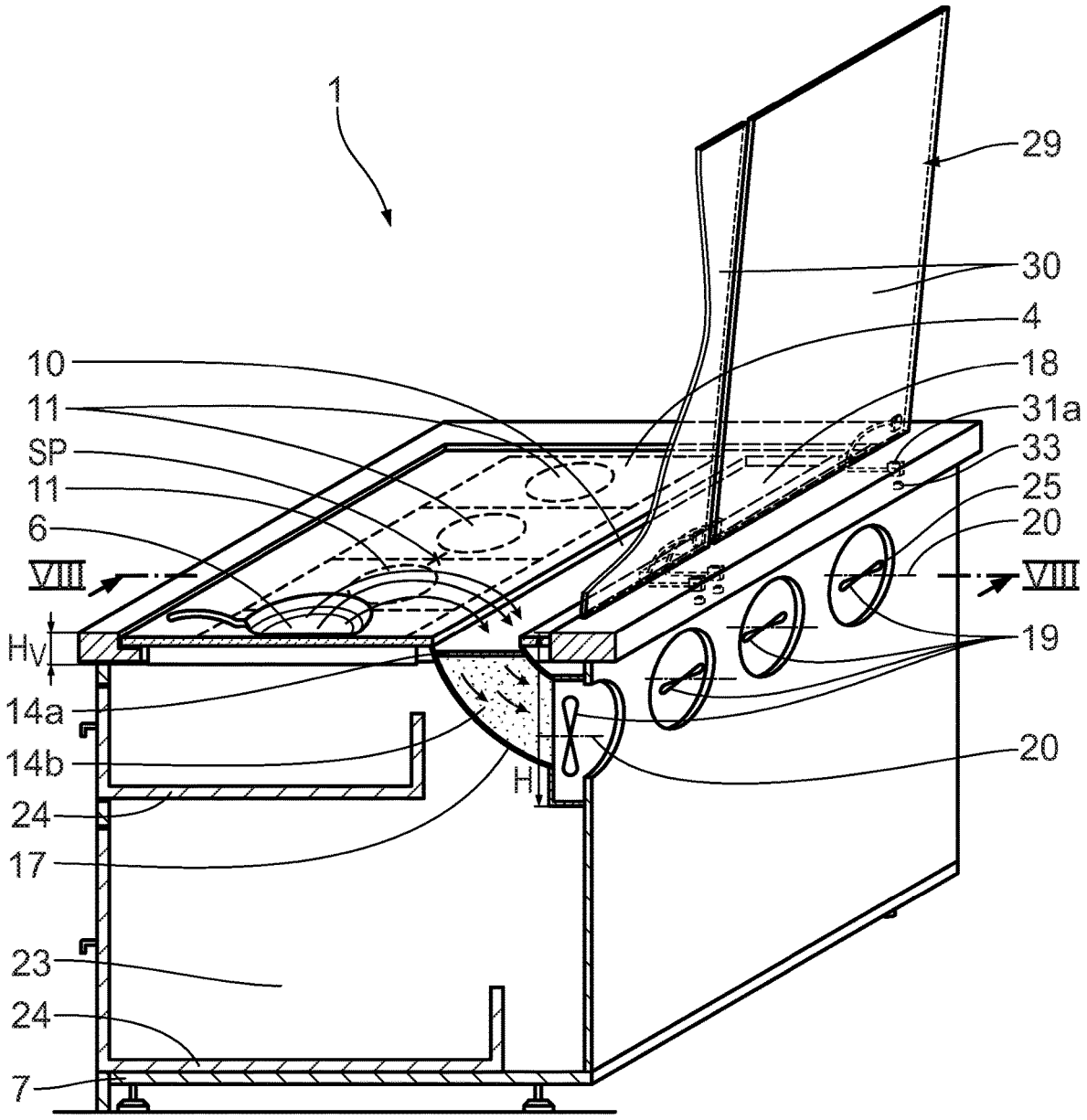
FIG. 7 shows a perspective rear view of a stove top system according to a further exemplary embodiment, wherein the stove top system has a stove top having four heating units which are disposed beside one another, a stove top cover having two cover members which are repositionable in a mutually independent manner, and a fume extraction device having an inflow opening which is disposed on the rear side on the stove top.
Figure 8:
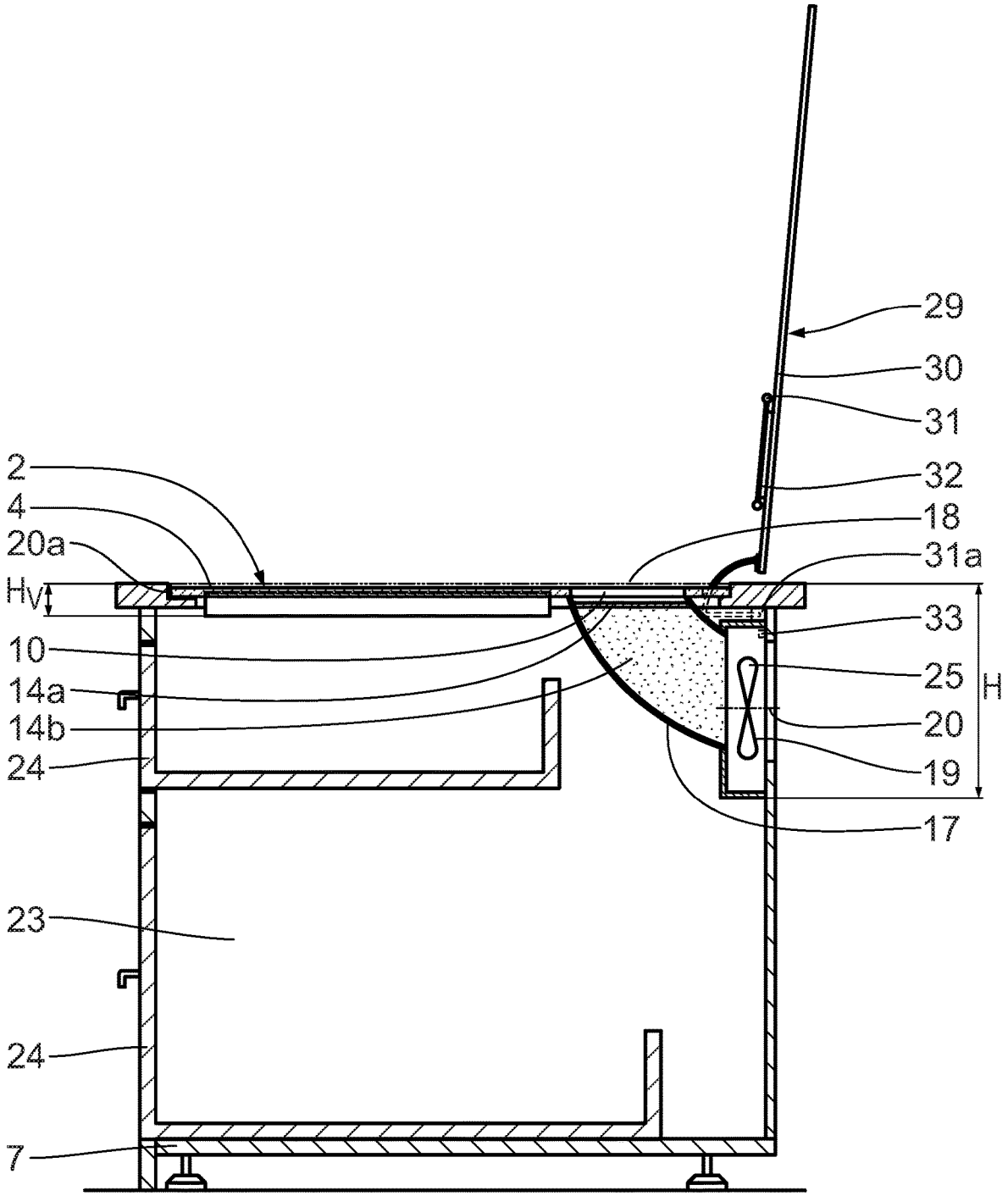
FIG. 8 shows a sectional view of the stove top system along the section line VIII-VIII in FIG. 7, wherein an odor filter of the extraction device is disposed in a negative-pressure duct portion disposed upstream of the fans.

A further exemplary embodiment of the invention is described on the basis of FIG. 7 and FIG. 8. As opposed to the preceding exemplary embodiments, the stove top system 1 comprises a stove top 2 having four heating units 5 which are disposed beside one another. An inflow opening 18 of the fume extraction device 3 has a rectangular contour and is disposed behind the heating units 5, or the cooktops 11, respectively. The inflow opening 18 by way of a negative-pressure duct portion 17 is aerodynamically connected to four fans 19 which have in each case one fan propeller 25. The rotation axes 20 of the fan propellers 25 are oriented so as to be mutually parallel and horizontal.

A maximum front installation height Hv in a horizontal region from a front edge 20*a* up to a geometric center of area SP of the stove top system 1 is 120 mm or less. The installation height HV of the stove top system 1 in this region can in particular be in the range of only 3 cm to 5 cm. The stove top system 1, has a minor installation height of this type in particular proceeding from the front edge 20*a* thereof across a depth T of at least 30 cm, in particular at least 40 cm. An overall height H of the stove top system 1 is 180 mm or less.

The stove top cover 29 has two cover members 30. The two cover members 30 are able to be disposed in a mutually independent manner between the open position and the closed position. Each of the cover members 30 in the closed position completely covers in each case two of the cooktops 11, and laterally half of the inflow opening 18.

The two cover members 30 are in each case attached to the stove top system 1 by way of a rotating mechanism 31*a*. The rotating mechanism 31*a* has a drive spring (not illustrated) and a damper element (likewise not illustrated). The rotating mechanism 31*a* guarantees that the respective cover member 30 can be opened and closed by way of a smooth and damped movement.

As is illustrated in FIG. 8, the fume extraction device 3 comprises two filters 14*a*, 14*b* that are disposed in the negative-pressure duct portion 17. The first filter 14*a* disposed in the direction of flow after the inflow opening 18 is configured as a grease filter, and the second filter 14*b* is configured as an odor filter. An activated carbon filter serves in particular as an odor filter. The second filter 14*b* can in particular have one or a plurality of activated carbon elements. Said activated carbon elements can be replaceable in a simple manner. Said activated carbon elements can in particular be able to be removed through the inflow opening 18.

Alternatively or additionally to the second filter 14*b* in the negative-pressure duct portion 17, an odor filter, in particular in the form of an activated carbon filter, can be disposed downstream of at least one of the fans 19. It is in particular possible for a corresponding odor filter to be disposed downstream of each of the fans 19. Said odor filters are preferably replaceable, in particular replaceable without tools. Said odor filters can in particular be able to be removed from the positive-pressure duct portion 26 by way of retrieval openings that are in each case provided.

The stove top cover 29 comprises in each case one closure lid 32 which for closing the inflow opening 18 in an air-tight manner is connected to the cover member 30. The cover member 30 is disposed so as to be spaced apart from the closure lid 32.

The functional mode of the stove top system 1 corresponds to the functional mode of the stove top system 1 according to the aforementioned exemplary embodiments. On account of the relative repositioning capability of the cover members 30 in relation to one another, the inflow opening 18 can selectively be covered not at all, so as to be laterally half-covered, or be completely covered. When half the inflow opening 18 is laterally covered, the extraction output is increased in the non-covered region of the inflow opening 18 while the output of the fans 19 remains the same. The non-covered cooktops 11 can continue to be used for heating food 6. The cooktops 11 covered by the cover members 30 are automatically deactivated. To this end, the control unit is connected in terms of signals to contact switches 33 for detecting the cover member 30 disposed in the closed position.

Figure 9:
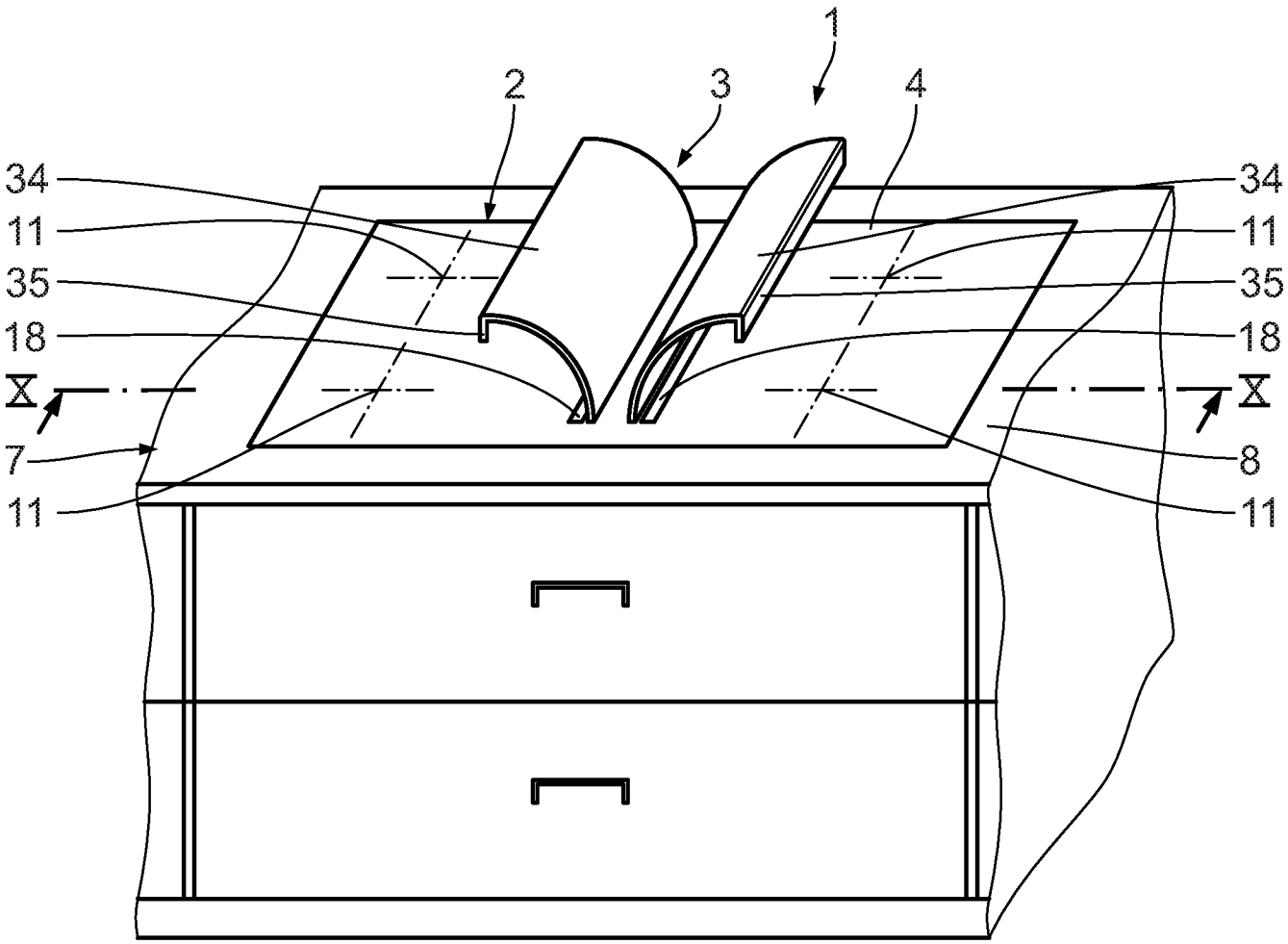
FIG. 9 shows a perspective illustration of a stove top system according to a further exemplary embodiment, having two repositionable cooking odor directing elements for masking in each case one side of an upper space lying upstream of an inflow opening.
Figure 10:
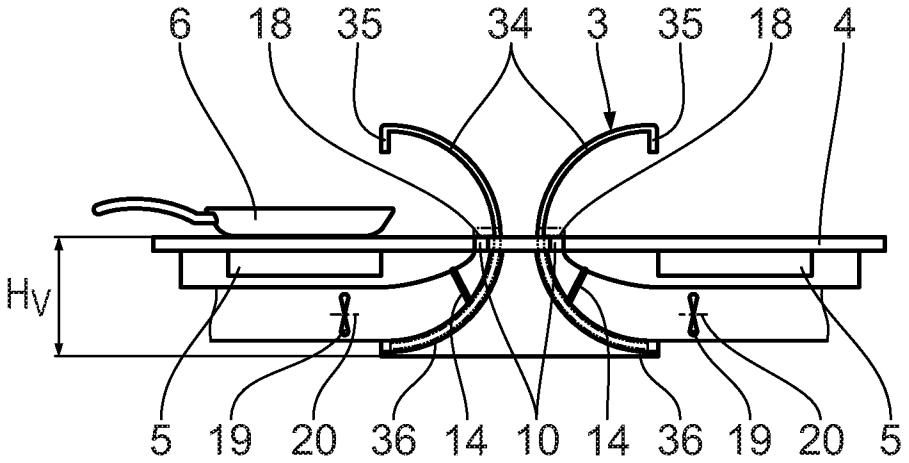
FIG. 10 shows a sectional illustration of the stove top system along the section line X-X in FIG. 9, having two fans which are disposed downstream of the two inflow openings.

A further exemplary embodiment of the invention is described by means of FIG. 9 and FIG. 10. As opposed to the preceding exemplary embodiments, the extraction device 3 comprises two inflow openings 18 which are formed by two inflow ducts 10 that penetrate the food carriers 4. The fume extraction device 3 moreover comprises two baffle elements 34 which are disposed so as to neighbor the inflow openings 18 and are oriented so as to be parallel to a main extent of the inflow openings 18. The baffle elements 34 are in each case configured as a shell with a single curvature. The baffle elements 34 are able to be repositioned relative to the food carrier 4 between a restoring position and a directing position. The respective baffle element 34 in the directing position is at least in portions disposed above the food carrier 4. The respective baffle element 34 in the directing position laterally masks in each case an upper space that lies upstream of the respective inflow opening 18 in relation to the inflow opening 18. In the restoring position, an upper side of the respective baffle element 34 is disposed so as to be flush with the surface of the respective inflow opening 18 that adjoins said baffle element 34.

The baffle elements 34 have a closure element 35. The closure element 35 is configured for covering the respective inflow opening 18 in the restoring position.

As is illustrated in FIG. 10, the stove top system 1 has one gate guide 36 for repositioning each of the baffle elements 34.

The functional mode of the stove top system 1 illustrated in FIGS. 9 and 10 corresponds to the functional mode of the stove top system according to the exemplary embodiments described above. The repositioning of the respective baffle element 34 along the gate guide 36 enables one side of the upper space to be masked in order for the cooking fumes to be extracted in a directed manner in the directing position, and the respective inflow opening 18 to be closed in the restoring position, wherein an exit of odors from the fume extraction device 3 is reliably prevented.

Figure 11:
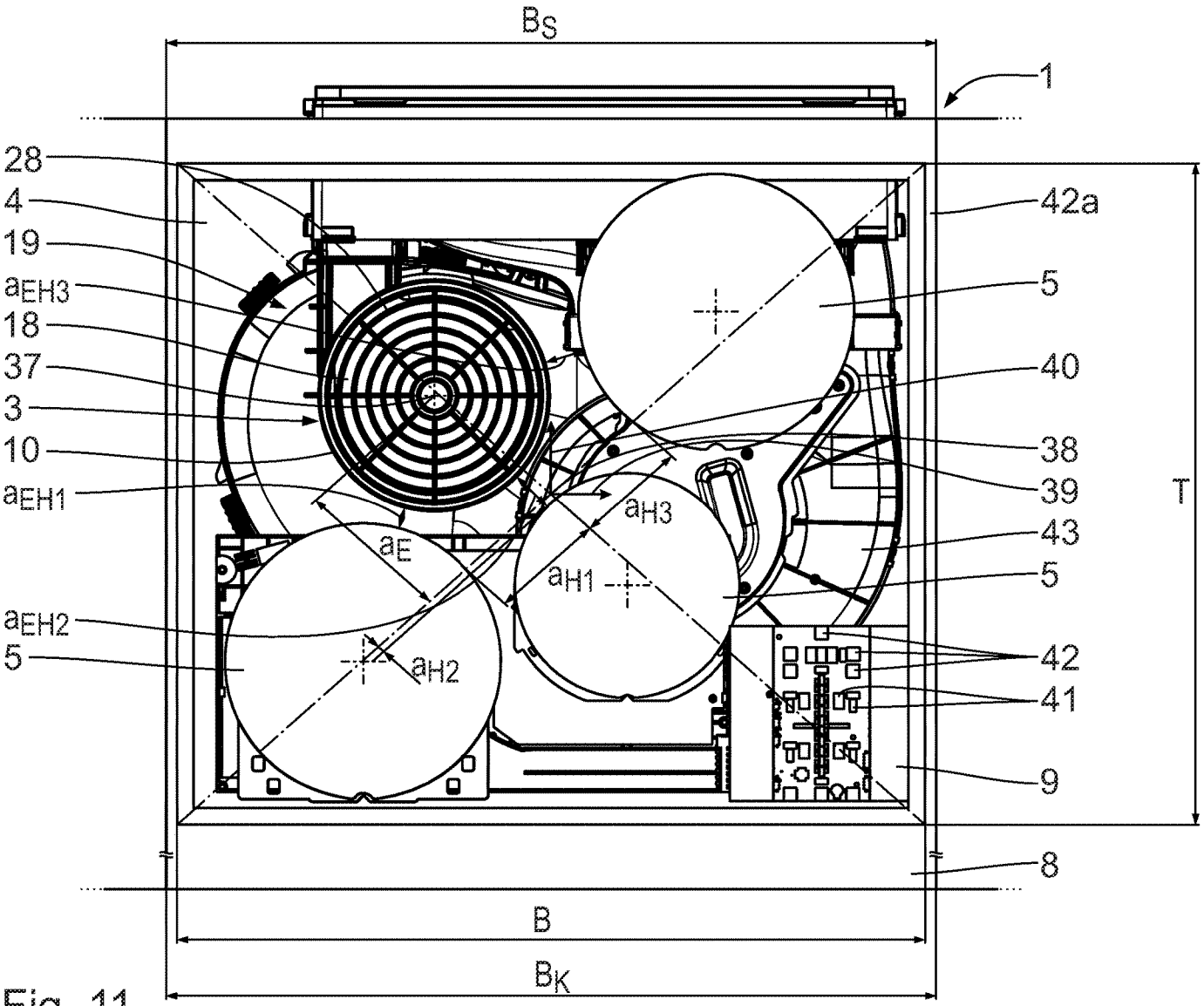
FIG. 11 shows a plan view onto a stove top system according to a further exemplary embodiment, having a food carrier, three heating units disposed thereon, and a fume extraction device for the downward extraction of cooking fumes, wherein an overall width of the stove top system is 560 mm, and wherein all of the heating units, when viewed in a plan view, are disposed at equal spacing from the inflow opening.

A further exemplary embodiment of the invention will be described on the basis of FIG. 11 and FIG. 12. As opposed to be preceding exemplary embodiments, the stove top system 1 has a food carrier 4, three heating units 5, and a fume extraction device 3 having exactly one fan 19. The fan 19 of the fume extraction device 3 is configured as a radial fan. The fan 19 is fluidically connected to the inflow opening 18 by way of the inflow duct 10.

An overall width B of the stove top system 1 is 560 mm. The overall installation height H of the stove top system 1, including the fan 19, is 180 mm. The depth T of the stove top system 1 is 515 mm.

The fume extraction device 3 comprises the fan 19, wherein the stove top system 1 is configured as a combination apparatus for the integral installation in the worktop 8.

The inflow opening 18 of the fan 19 penetrates the food carrier 4. When viewed in a plan view, the inflow opening 18 is circular. The fume extraction device 3 has an inflow mesh 28 which is able to be reversibly disposed on the inflow opening 18. When viewed in a plan view, the inflow mesh 28 completely covers the inflow opening 18. The inflow mesh 28 comprises fin-shaped baffle elements 34 which for supporting a laminar extraction of the cooking fumes through the inflow mesh 28 and the inflow opening 18 are disposed so as to be mutually concentric.

A geometric center of area 37 of the inflow opening 18 is disposed so as to be spaced apart from a geometric center of area 38 of the food carrier 4. A spacing $a_E$ between the geometric center of area 37 of the inflow opening 18 and the geometric center of area 38 of the food carrier 4 is 100 mm. The geometric center of area 37 of the inflow opening 18, when viewed in the plan view, is disposed so as to be spaced apart from the geometric center of area 38 of the food carrier 4 along a width direction 39 as well as along a depth direction 40.

A minimum spacing $a_{H1}$ between the first heating unit 5 and the geometric center of area 38 of the food carrier 4 is 75 mm, and a minimum spacing $a_{H2}$ between the second heating unit 5 and the geometric center of area 38 of the food carrier 4 is 10 mm. A minimum spacing $a_{EH1}$ between the inflow opening 18 and the first heating unit 5 is equal to a minimum spacing $a_{EH2}$ between the inflow opening 18 and the second heating unit 5, and equal to a minimum spacing $a_{EH3}$ between the inflow opening 18 and the third heating unit 5. The minimum spacing $a_{EH1}$, $a_{EH2}$, $a_{EH3}$ between the inflow opening and the heating units 5 is 40 mm.

The stove top system 1 has the user interface 9. The user interface 9 comprises a touch-sensitive surface 41 as well as a multiplicity of display elements 42. The user interface 9 is configured for controlling the heating units 5 and the fume extraction device 3. When viewed in a plan view, the user interface 9 relative to one of the heating units 5 is disposed opposite the inflow opening 18. In particular, an external periphery of the user interface 9 along the width direction 39 and along the depth direction 40 is disposed so as to be spaced apart from the geometric center of area 38 of the food carrier 4. The user interface 9 is disposed in a lateral peripheral region of the food carrier 4.

Figure 12:
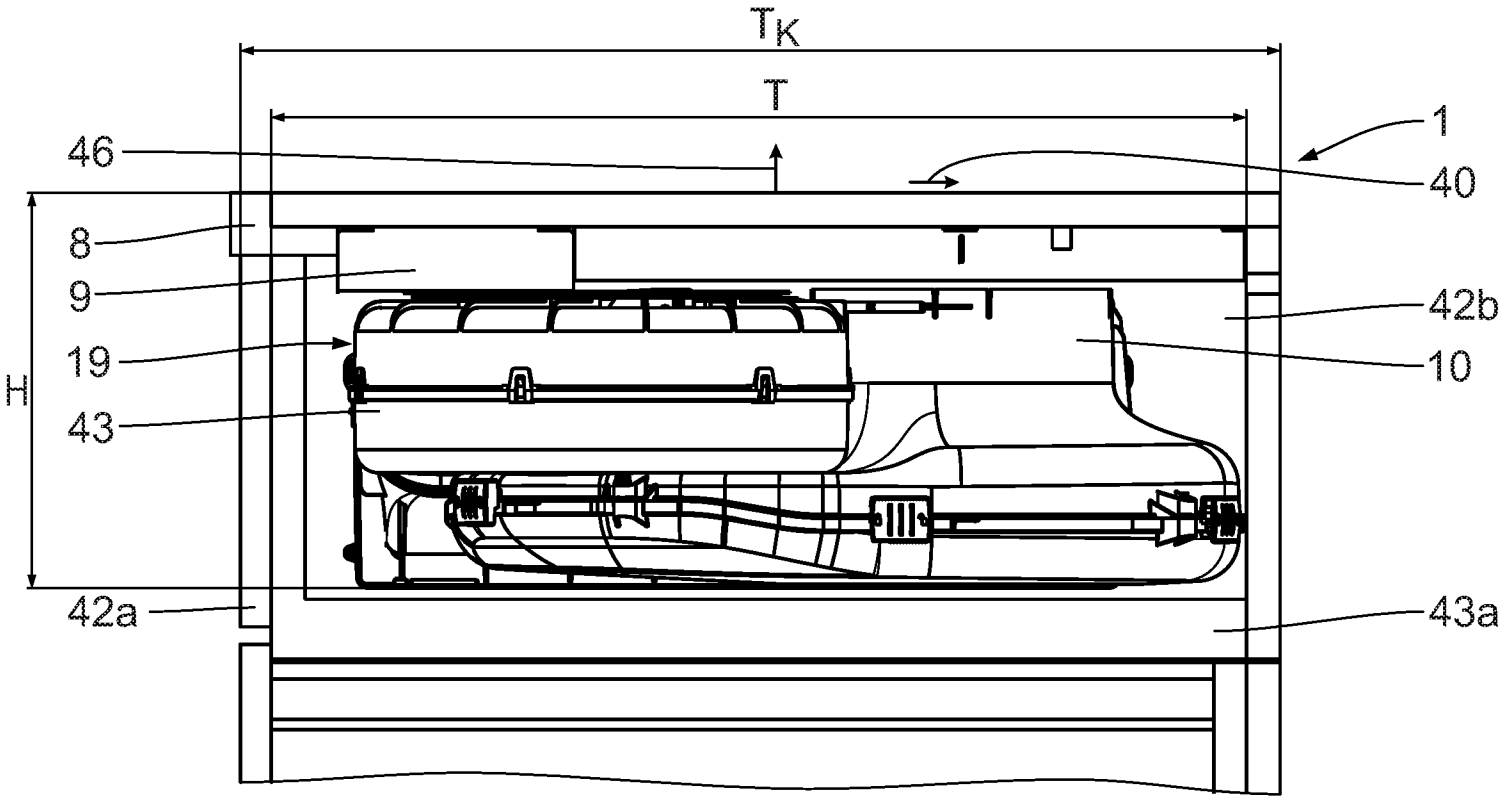
FIG. 12 shows a lateral view of the stove top system in FIG. 11.

The stove top system 1 is illustrated in a lateral view in FIG. 12. The fan 19 comprises a fan housing 43. The fan housing 43 is disposed above a lowest point of the inflow duct 10. A spacing between the lowest point of the inflow duct 10 and the fan housing 43 is 50 mm. The fan housing 43 is completely disposed below the heating elements 5. A particularly compact configuration of the stove top system 1 in the horizontal direction is thus guaranteed.

The stove top system 1 is at least partially received in a kitchen base unit 42*a*. The stove top system 1 penetrates the worktop 8 which is supported on the kitchen base unit 42*a*. A unit width BK of the kitchen base unit 42*a* is 600 mm. A unit depth TK of the kitchen base unit 42*a* is likewise 600 mm. The kitchen base unit 42*a* has a storage space 42*b* for receiving the stove top system 1 as well as draws or shelves. A storage space width $B_S$ of the kitchen base unit 42*a* is 580 mm.

The kitchen base unit 42*a* has an insulation 43*a*. The insulation 43*a* is disposed on the kitchen base unit 42*a* in such a manner that said insulation surrounds a lower side and a front side of the stove top system 1. The insulation 43*a* guarantees a reduced noise emission and a reduced thermal input into a lower region of the kitchen base unit 42*a*.

The functional mode of the stove top system 1 according to this exemplary embodiment corresponds to the functional mode of the stove top systems 1 described above.

Figure 13:
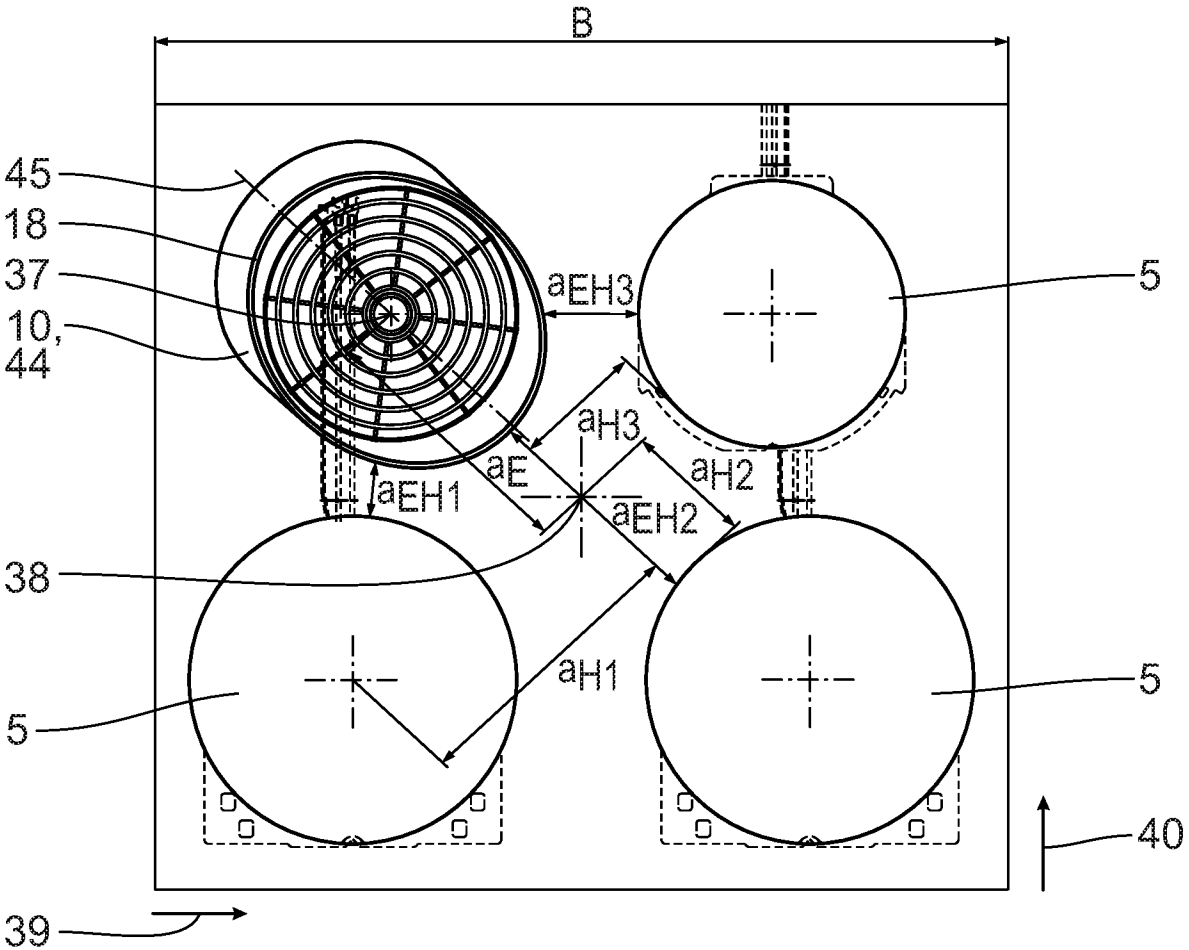
FIG. 13 shows a plan view onto a stove top system according to a further exemplary embodiment, wherein a central longitudinal axis of an inflow duct is configured so as to be inclined in relation to a stove top normal.

A further exemplary embodiment of the stove top system 1 is illustrated in FIG. 13. As opposed to the stove top systems 1 described above, an initial portion 44 of the inflow duct 10 has a central longitudinal axis 45 which is oriented so as to be oblique to a stove top normal 46. An angle between the central longitudinal axis 45 of the initial portion 44 and the stove top normal 46 is 45°.

The initial portion 44 is circular in the cross section. On account of the oblique orientation of the central longitudinal axis 45 in relation to the stove top normal 46, the inflow opening 18 is of elliptic shape.

On account of the overall width B of the stove top system being at most 600 mm, in particular 560 mm, a disposal of the stove top system 1 with the fume extraction device 3 is for the first time enabled in a kitchen base unit 42*a* having particularly minor dimensions. It is advantageously achieved on account thereof that stove top systems 1 of this type are able to be used in a particularly flexible manner and thus able to be installed to a significantly larger extent. An embodiment of the stove top system 1 having an installation height of at most 200 mm is particularly advantageous, since the storage space 42*b* is largely maintained for receiving cooking utensils, for example.

Figure 14:
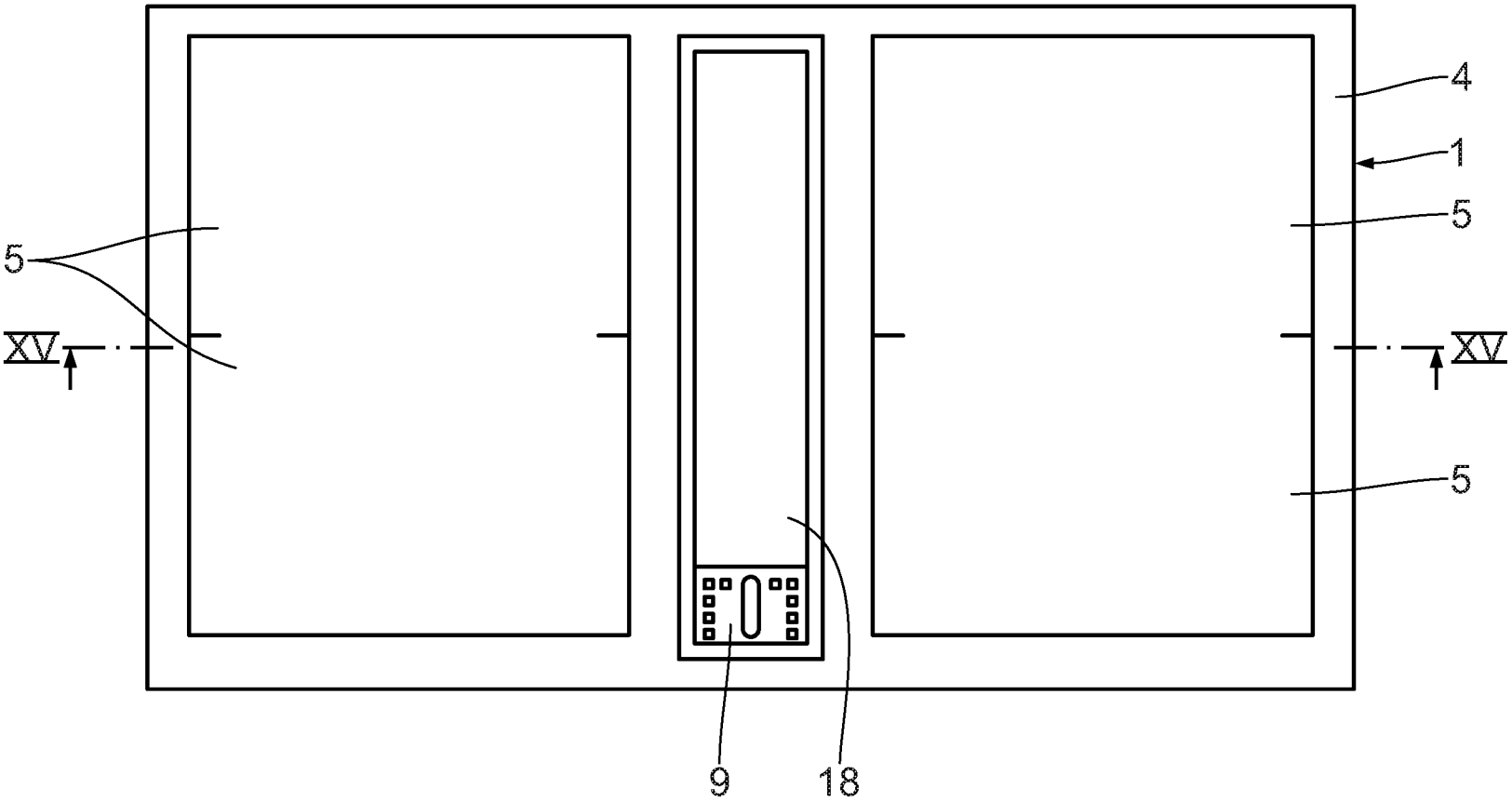
FIG. 14 shows a plan view onto a stove top system having four heating units and a fume extraction device.
Figure 15:
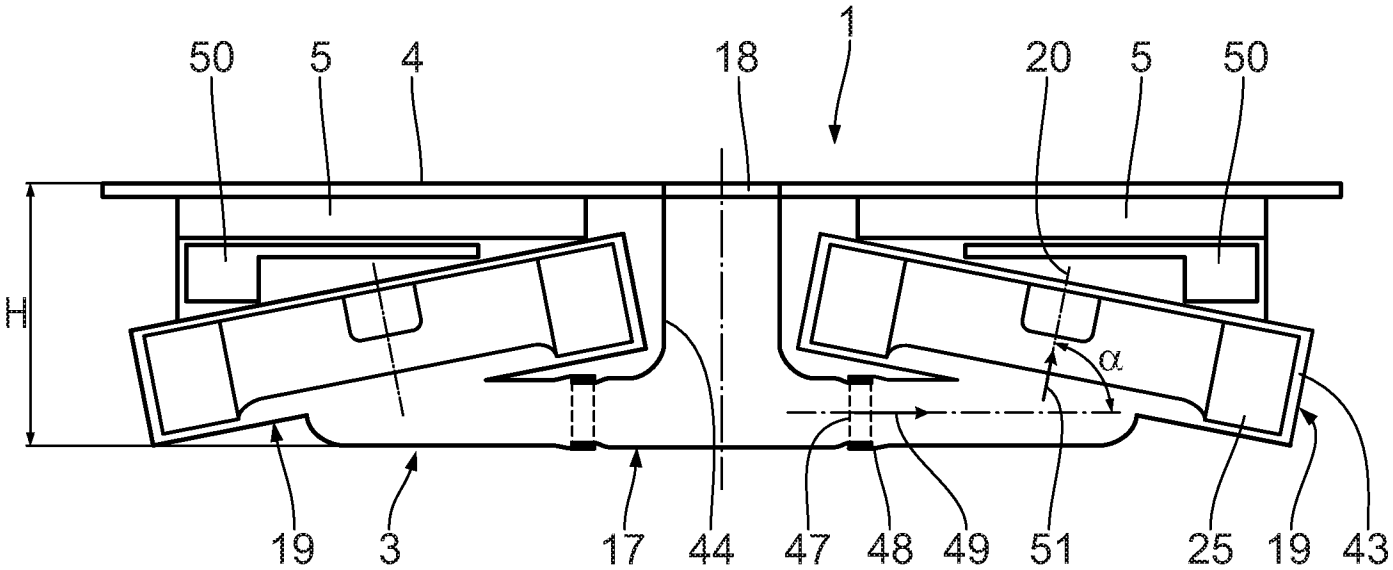
FIG. 15 shows a sectional illustration of the stove top system along the section line XV-XV in FIG. 14, having two fans which have in each case one fan propeller that is mounted so as to be rotatable about a rotation axis, wherein the rotation axis is oriented so as to be inclined in relation to a horizontal plane and to a vertical direction.

A further exemplary embodiment of the stove top system 1 is illustrated in FIG. 14 and FIG. 15. As opposed to the stove top systems 1 described above, the fume extraction device 3 comprises two fans 19 having in each case fan propellers 25 which are mounted so as to be rotatable about a rotation axis 20, wherein the rotation axes 20 are in each case oriented so as to be inclined in relation to a horizontal plane and in relation to a vertical direction. The stove top system 1, when viewed in a plan view, comprises four rectangular heating units 5. The heating units 5 and the fume extraction device 3 are connected in terms of signals to a user interface 9.

The fume extraction device 3 has an inflow opening 18 which is centrally disposed on a food carrier 4. An initial portion 44 of a negative-pressure duct portion 17 is connected to the inflow opening 18.

The fans 19 have in each case one fan housing 43. The fan housing 43 comprises a negative-pressure connector opening 47. The initial portion 44 penetrates the negative-pressure connector opening 47. A duct connection 48 connects the initial portion 4 in a fluid-tight manner to the fan housing 43.

A connector normal 49 is oriented so as to be perpendicular to the negative-pressure connector opening 47. The connector normal 49 conjointly with the rotation axis 20 encloses a connector angle $\alpha$ of 80°.

A power electronics unit 50 for supplying the heating units 5 is attached below the respective heating unit 5. A space which in a region between the respective heating unit 5 and the fan 19 is required for the power electronics unit 15, in particular for individual components of the power electronics unit 15 that are particularly intensive in terms of installation space, is provided by inclining the rotation axis 20.

When viewed in a plan view as well as in a lateral view, the two fans 19 overlap the heating units 5. On account thereof, the stove top system 1 is of a particularly compact configuration. An overall installation height H is 180 mm.

A suction installation 51 of the fan 19 has a directional component which is directed vertically upward. The suction installation 51 is oriented so as to be parallel to the rotation axis 20. On account of the suction installation 51 having the upward-pointing directional component, the fan 19 is reliably protected in relation to ingressing liquids.

The invention claimed is:

1. A stove top system comprising:

at least one cooking fume extractor for the downward extraction of cooking fumes, having at least one inflow opening for the inflow of the cooking fumes; and at least one fan for suctioning the cooking fumes at the at least one inflow opening, such fan having a fan propeller that is mounted so as to be rotatable about a rotation axis; and a filter for filtering the cooking fumes, which is configured as a grease filter, wherein the rotation axis is oriented so as to be inclined in relation to a horizontal plane and to a vertical direction; and at least one heating unit for heating food, wherein the at least one fan, when viewed in a plan view overlaps the at least one heating unit and when viewed in at least one of a lateral view and a front view, overlaps the at least one heating unit.

2. The stove top system as claimed in claim 1, wherein an inclination angle between the horizontal plane and the rotation axis is in a range from 10° to 85°.

3. The stove top system as claimed in claim 1, wherein a suctioning direction of the fan at a downstream end of a negative-pressure duct portion has an upward-pointing directional component.

4. The stove top system as claimed in claim 1, comprising a negative-pressure duct portion which fluidically connects the at least one inflow opening to the at least one fan, wherein a duct centerline of the negative-pressure duct portion along the extent thereof has an absolute angular variation in a range from 100° to 170°.

5. The stove top system as claimed in claim 1, comprising a control unit for controlling the at least one of at least one cooking fume extractor and the at least one heating element, wherein the at least one fan, when viewed in at least one of a plan view, in a lateral view and in a front view, overlaps the at least one control unit.

6. The stove top system as claimed in claim 1, wherein a vertical overall height of the stove top system is at most 200 mm.

7. The stove top system as claimed in claim 1, the at least one fan having a fan housing having a negative-pressure connector opening, wherein the fan propeller is disposed in the fan housing;

wherein the rotation axis conjointly with a connector normal that is oriented so as to be perpendicular to the negative-pressure connector opening encloses a connector angle in a range from 10° to 85°.

8. The stove top system as claimed in claim 7, wherein the connector angle is in a range from 30° to 80°.

9. The stove top system as claimed in claim 1, wherein an inclination angle between the horizontal plane and the rotation axis is in a range from 30° to 80°.

10. The stove top system as claimed in claim 1, wherein a duct centerline of the negative-pressure duct portion along the extent thereof has an absolute angular variation in a range from 120° to 150°.

11. The stove top system as claimed in claim 1, having a food carrier wherein the at least one inflow opening, when viewed in the plan view, is disposed in a central region of the food carrier.

* * * * *